US011371480B2

(12) United States Patent
Oryoji et al.

(10) Patent No.: US 11,371,480 B2
(45) Date of Patent: Jun. 28, 2022

(54) CONTROL DEVICE

(71) Applicant: Hitachi Astemo, Ltd., Hitachinaka (JP)

(72) Inventors: Kazuhiro Oryoji, Tokyo (JP); Yoshihiko Akagi, Hitachinaka (JP); Hidefumi Iwaki, Hitachinaka (JP)

(73) Assignee: Hitachi Astemo, Ltd., Hitachinaka (JP)

( * ) Notice: Subject to any disclaimer, the term of this patent is extended or adjusted under 35 U.S.C. 154(b) by 0 days.

(21) Appl. No.: 17/293,735

(22) PCT Filed: Dec. 23, 2019

(86) PCT No.: PCT/JP2019/050251
§ 371 (c)(1),
(2) Date: May 13, 2021

(87) PCT Pub. No.: WO2020/145105
PCT Pub. Date: Jul. 16, 2020

(65) Prior Publication Data

US 2022/0010762 A1 Jan. 13, 2022

(30) Foreign Application Priority Data

Jan. 9, 2019 (JP) ..... JP2019-001735

(51) Int. Cl.
*F02P 3/05* (2006.01)
*F02P 3/045* (2006.01)
(Continued)

(52) U.S. Cl.
CPC ..... *F02P 3/05* (2013.01); *F02D 13/0234* (2013.01); *F02P 3/045* (2013.01); *F02P 5/1502* (2013.01);
(Continued)

(58) Field of Classification Search
CPC .... F02P 3/045; F02P 3/05; F02P 17/12; F02P 2017/121
(Continued)

(56) References Cited

U.S. PATENT DOCUMENTS

2013/0160739 A1 6/2013 Suzuki et al.
2018/0156182 A1* 6/2018 Hattori ..... F02D 41/1454
(Continued)

FOREIGN PATENT DOCUMENTS

JP 2012-62865 A 3/2012
JP 2014-145306 A 8/2014
JP 2016-217190 A 12/2016

OTHER PUBLICATIONS

International Search Report (PCT/ISA/210) issued in PCT Application No. PCT/JP2019/050251 dated Mar. 17, 2020 with English translation (four (4) pages).
(Continued)

*Primary Examiner* — Erick R Solis
(74) *Attorney, Agent, or Firm* — Crowell & Moring LLP

(57) ABSTRACT

Due to changes in a flow of an air-fuel mixture in a cylinder, reliable ignition due to spark discharge may not be possible. Therefore, an ignition control unit 24 includes a secondary voltage calculation unit 31 that calculates an average value of a secondary voltage generated on a secondary side of an ignition coil, an irregular flow ratio calculation unit 32 that calculates a ratio of cycles in which the average value of the secondary voltage is equal to or less than a set average value with respect to a cycle of the internal combustion engine in a predetermined period as an irregular flow ratio indicating that the flow of the air-fuel mixture in the cylinder is irregular, and an ignition operation amount correction unit 37 that corrects an ignition operation amount so that the
(Continued)

irregular flow ratio is equal to or less than the set ratio value that is the target to be reached of the irregular flow ratio.

20 Claims, 17 Drawing Sheets

(51) Int. Cl.
*F02P 17/12* (2006.01)
*F02D 13/02* (2006.01)
*F02P 5/15* (2006.01)

(52) U.S. Cl.
CPC ..... *F02P 17/12* (2013.01); *F02D 2200/0418* (2013.01); *F02D 2200/101* (2013.01); *F02D 2200/1002* (2013.01); *F02P 2017/121* (2013.01)

(58) Field of Classification Search
USPC ..... 123/406.24, 406.26, 644
See application file for complete search history.

(56) References Cited

U.S. PATENT DOCUMENTS

2018/0283344 A1 10/2018 Sugita et al.
2018/0372058 A1* 12/2018 Hagari ..... F02P 3/0442
2021/0222664 A1* 7/2021 Ohata ..... F02P 9/007

OTHER PUBLICATIONS

Japanese-language Written Opinion (PCT/ISA/237) issued in PCT Application No. PCT/JP2019/050251 dated Mar. 17, 2020 (three (3) pages).

* cited by examiner

CONTROL DEVICE

TECHNICAL FIELD

The present invention relates to a control device for controlling an internal combustion engine.

BACKGROUND ART

There are various methods for improving fuel efficiency performance of an automobile, but it is important to reduce the fuel consumption of an internal combustion engine. In order to reduce the fuel consumption, it is effective to reduce various losses such as pump loss, cooling loss, and exhaust loss that occur during operation of the internal combustion engine. For example, as a method of reducing the pump loss and the cooling loss, lean combustion in which a ratio of fuel and air is diluted compared to a quantitative mixing ratio (theoretical mixing ratio) and combustion is performed, or a combustion method utilizing exhaust gas recirculation (EGR) gas that dilutes an air-fuel mixture of fuel and air by returning a portion of combustion gas to an intake side has been known. In the following description, the lean combustion or the combustion method utilizing the EGR gas is collectively referred to as "diluted combustion". In addition, intake air flowing into a cylinder of the internal combustion engine is called "gas", and a gas mixed with the fuel in the cylinder is called "air-fuel mixture".

When the diluted combustion is used, an intake pipe pressure can be increased as compared with the case where the diluted combustion is not used. Therefore, the cooling loss can be reduced by reducing the pump loss under the condition that a load of the internal combustion engine is low, or by increasing a heat capacity and lowering a combustion temperature of the air-fuel mixture. In addition, under the condition that the load of the internal combustion engine is high, since a reaction progress leading to a self-ignition reaction is suppressed by introducing the EGR gas, an occurrence of abnormal combustion is suppressed. As a result, an ignition timing can be advanced so as to approach an optimum timing, and the exhaust loss can be reduced.

In order to reduce the fuel consumption, it is necessary to set an appropriate dilution degree of the air-fuel mixture (gas fuel ratio described below) according to the operating conditions. For example, the dilution degree of the air-fuel mixture is often evaluated by a ratio of mass sum of a mixed gas consisting of air or EGR gas to a mass of the fuel (gas-fuel ratio G/F), a mass ratio of air to fuel (air-fuel ratio A/F), and a ratio of the EGR gas in the intake air gas (EGR rate).

In order to avoid misfire and achieve combustion under the condition of high dilution degree (state of the diluted air-fuel mixture), since a relative concentration of fuel is small, it is necessary to increase a supply energy supplied from an ignition plug to the air-fuel mixture in the cylinder at the time of spark ignition. In addition, in order to realize stable combustion under the condition of high dilution degree, it is necessary to increase a turbulent flow intensity or a flow velocity of the air-fuel mixture in the cylinder of the internal combustion engine as compared with the conventional case.

However, if the turbulent flow intensity or the flow velocity in the cylinder becomes large, there is a possibility that a misfire may occur due to a phenomenon such as a discharge from the ignition plug being blown out. Also in this case, it is necessary to increase the supply energy supplied from the ignition plug to the air-fuel mixture in the cylinder at the time of spark ignition. In addition, if a flow direction of the air-fuel mixture changes around the plug during a discharge period and the flow of the air-fuel mixture becomes irregular, a transfer efficiency of the supply energy to the air-fuel mixture decreases. Therefore, it is necessary to set a large amount of supply energy under the ignition retard condition in which the flow of the air-fuel mixture is likely to be irregular during the discharge period.

Therefore, the supply energy needs to be set in consideration of whether the flow direction in the cylinder does not change (is regular) or changes (is irregular) during the discharge period. As a technique for increasing the supply energy supplied from the ignition plug to the air-fuel mixture in the cylinder according to the state of the flow in the cylinder, for example, an ignition device for an internal combustion engine disclosed in PTL 1 is known.

PTL 1 describes that "by calculating a command value of a secondary current based on the flow velocity in the cylinder, the secondary current can be controlled so that the spark discharge does not blow out."

CITATION LIST

Patent Literature

PTL 1: JP 2016-217190 A

SUMMARY OF INVENTION

Technical Problem

According to the technique disclosed in PTL 1, it is possible to set a current value proportional to a flow velocity in a cylinder as a current value generated in a secondary coil. Therefore, it has been considered that it is possible to prevent a spark discharge from being blown out and to realize reliable ignition under the condition that the flow velocity in the cylinder is large.

However, the technique disclosed in PTL 1 does not consider a method of determining a required value of the energy supplied by the ignition plug to the air-fuel mixture depending on the presence or absence of a change in the flow direction in the cylinder. When the condition for controlling the blowout is simply that the flow velocity in the cylinder is large, lean combustion is performed, or when the flow velocity of the gas flowing into the cylinder is increased by a tumble control valve, the ignition plug supplies excess energy to the air-fuel mixture, which accelerates the deterioration of the ignition plug. Therefore, it is desired to formulate a control method corresponding to the problem that it is necessary to set the energy in consideration of whether the flow direction in the cylinder does not change (regular) or changes (irregular) during the discharge period.

The present invention has been made in view of such a situation, and an object of the present invention is to change an ignition operation amount for igniting an air-fuel mixture in consideration of a change in a flow direction of the air-fuel mixture in a cylinder.

Solution to Problem

The control device according to the present embodiment includes an ignition control unit that supplies a primary voltage to a primary side of an ignition coil provided in an internal combustion engine according to a predetermined ignition operation amount, discharges an ignition plug provided in the internal combustion engine, and controls an ignition of an air-fuel mixture in which a gas sucked into a cylinder of the internal combustion engine and a fuel are mixed, and controls the internal combustion engine by the ignition control unit. The ignition control unit includes a secondary voltage calculation unit that calculates an average value of a secondary voltage generated on a secondary side of the ignition coil; an irregular flow ratio calculation unit that calculates a ratio of a cycle in which the average value of the secondary voltage is equal to or less than a set average value with respect to a cycle of the internal combustion engine in a predetermined period as an irregular flow ratio indicating that a flow of the air-fuel mixture in the cylinder is irregular; and an ignition operation amount correction unit that corrects an ignition operation amount so that the irregular flow ratio is equal to or less than a set ratio value that is a target to be reached of the irregular flow ratio.

In addition, the control device according to the present embodiment includes an ignition control unit that supplies a primary voltage to a primary side of an ignition coil provided in an internal combustion engine according to a predetermined ignition operation amount, discharges an ignition plug provided in the internal combustion engine, and controls an ignition of an air-fuel mixture in which a gas sucked into a cylinder of the internal combustion engine and a fuel are mixed, and controls the internal combustion engine by the ignition control unit. The ignition control unit includes an irregular flow ratio estimation unit that estimates an estimated value of an irregular flow ratio indicating that a flow of an air-fuel mixture in the cylinder is irregular based on an operating state of the internal combustion engine; and an ignition operation amount correction unit that corrects an ignition operation amount so that the estimated value of the irregular flow ratio is equal to or less than a set ratio value that is the target to be reached of the irregular flow ratio.

Advantageous Effects of Invention

According to the present invention, it is possible to correct the ignition operation amount in consideration of the change in the flow direction of the air-fuel mixture around the ignition plug during the discharge period based on the irregular flow ratio, which indicates that the flow of gas sucked into the cylinder of the internal combustion engine is irregular.

The problems, configurations, and effects other than those described above are clarified from the description of the following embodiments.

DESCRIPTION OF EMBODIMENTS

Figure 1:
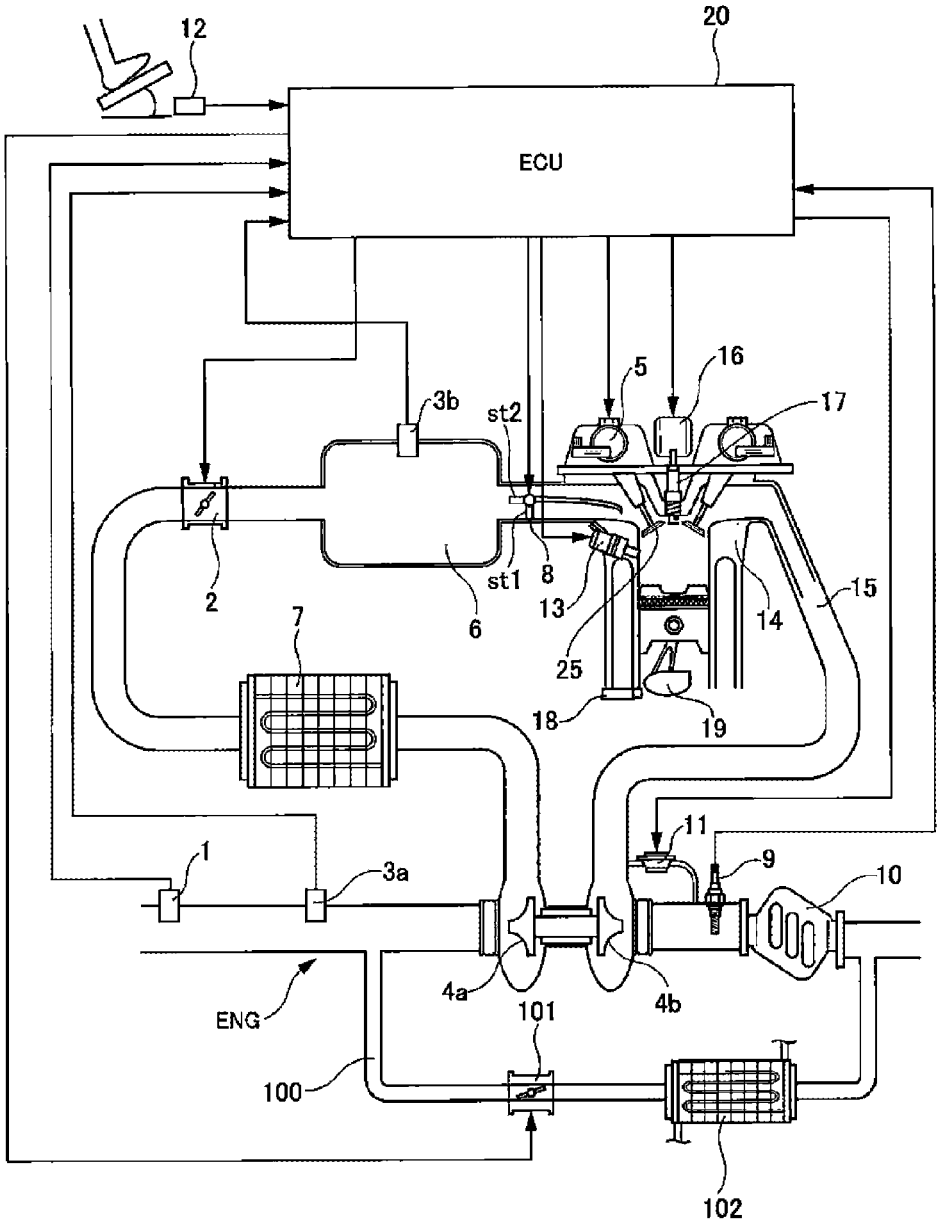
FIG. 1 is a schematic configuration diagram illustrating a configuration example of an internal combustion engine system according to a first embodiment of the present invention.

Hereinafter, embodiments for carrying out the present invention will be described with reference to the accompanying drawings. In the present specification and the drawings, components having substantially the same function or configuration are designated by the same reference numerals, and redundant description will be omitted.

First Embodiment

First, a configuration example of an internal combustion engine system including a control device for a spark-ignition type internal combustion engine used in an automobile will be described with reference to FIGS. 1 and 2.

FIG. 1 is a schematic configuration diagram illustrating a configuration example of an internal combustion engine system. The internal combustion engine system includes an in-cylinder fuel injection device (injector 13) that directly injects gasoline fuel into a cylinder.

An internal combustion engine ENG is an example of an in-cylinder injection type internal combustion engine for an automobile that carries out spark ignition combustion that uses an ignition coil 16 to generate a spark discharge in an ignition plug 17 to ignite an air-fuel mixture. An air flow sensor 1, humidity sensors 3*a* and 3*b*, a compressor 4*a*, an intercooler 7, and an electronically controlled throttle 2 provided in the internal combustion engine ENG are provided at the respective appropriate positions in an intake pipe.

The air flow sensor 1 measures an intake air amount and an intake air temperature.

The humidity detection unit (humidity sensors 3*a* and 3*b*) detects a humidity of gas introduced into the cylinder. Therefore, the humidity sensors 3*a* and 3*b* can detect an intake air humidity, that is, the amount of water in an air-fuel mixture of air and EGR gas.

The humidity sensor 3*a* is provided near the air flow sensor 1 and can detect the humidity of the intake air. In addition, the humidity sensor 3*b* is provided in a surge tank 6 and can detect the humidity of the air stored in the surge tank 6.

The compressor 4*a* is provided as a portion of a supercharger that supercharges the intake air into the cylinder.

The intercooler 7 cools the intake air.

The electronically controlled throttle 2 adjusts an intake pipe pressure.

In addition, the internal combustion engine ENG is provided with an injector 13 that injects fuel into the cylinder 14 of each cylinder and an ignition device (hereinafter, an ignition coil 16 and an ignition plug 17 are described separately) that supplies energy to the gas in the cylinder for each cylinder.

Figure 2:
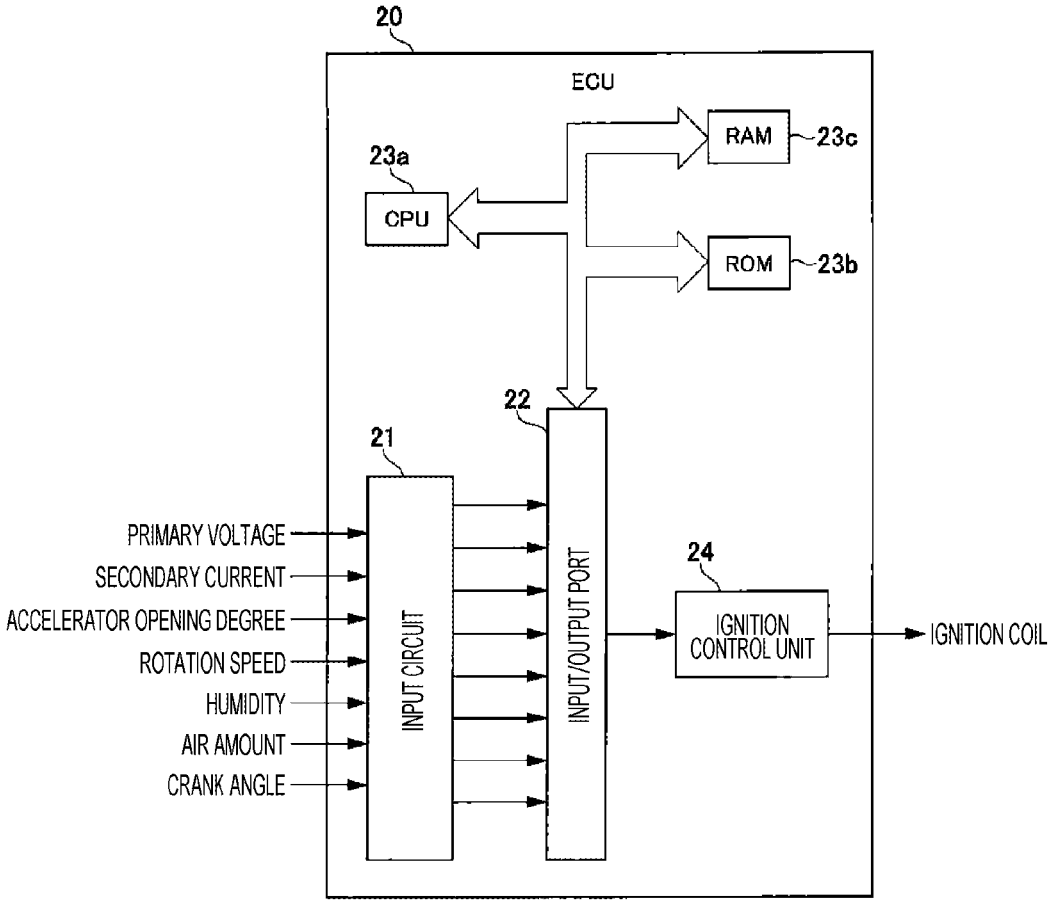
FIG. 2 is a control block diagram illustrating a configuration example of an ECU according to the first embodiment of the present invention.
Figure 3:
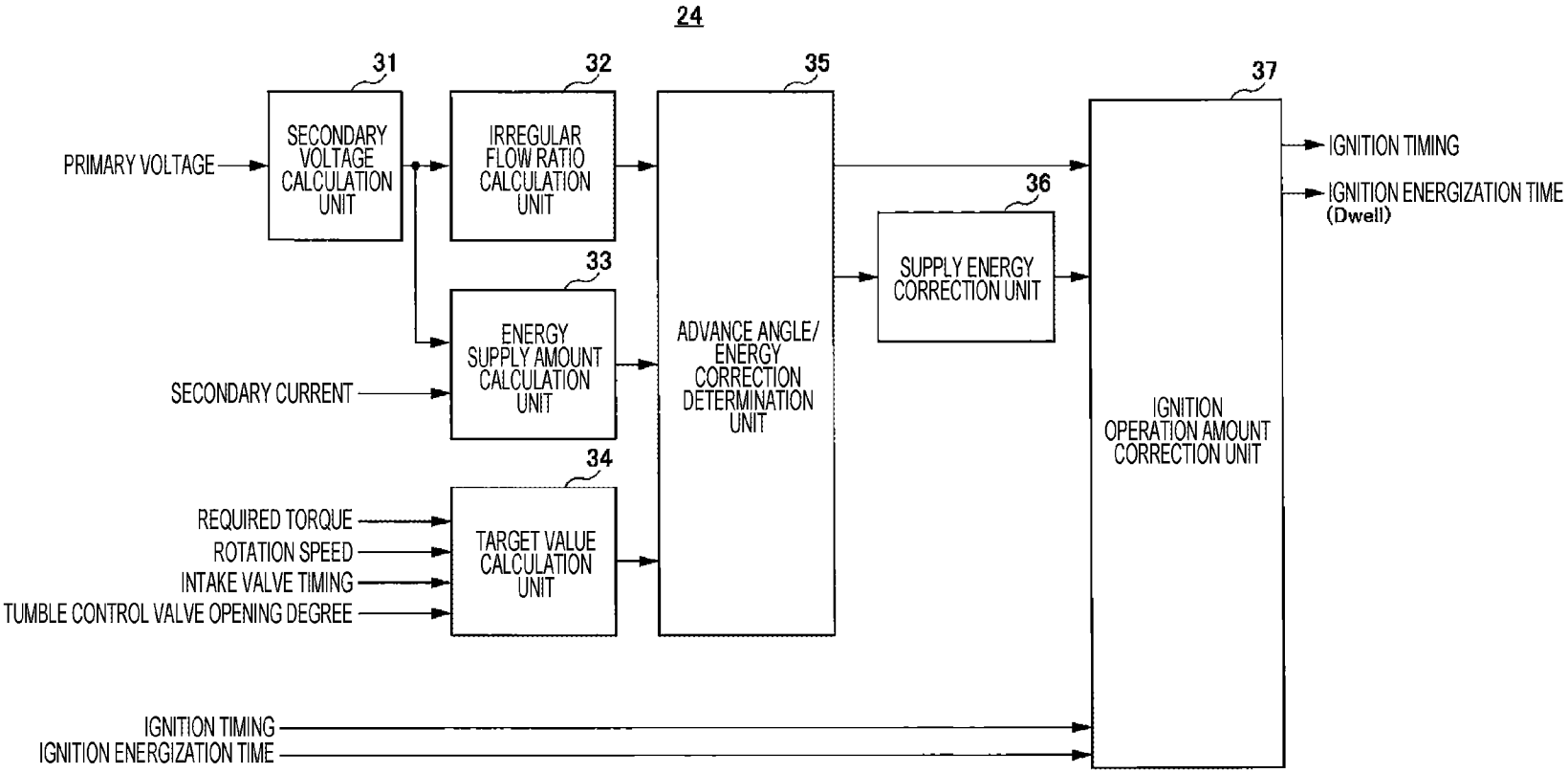
FIG. 3 is a block diagram illustrating an internal configuration example of an ignition control unit in an ECU which is a control device of an internal combustion engine according to the first embodiment of the present invention.

Then, the control device according to the present embodiment includes an ignition control unit (ignition control unit 24) that supplies a primary voltage to a primary side of the ignition coil (ignition coil 16) provided in the internal combustion engine (internal combustion engine ENG) according to a predetermined ignition operation amount, discharges the ignition plug (ignition plug 17) provided in the internal combustion engine (internal combustion engine ENG), and controls an ignition of the air-fuel mixture in which the gas sucked into the cylinder of the internal combustion engine (internal combustion engine ENG) and the fuel are mixed, and controls the internal combustion engine (internal combustion engine ENG) A configuration of the ignition control unit 24 is illustrated in FIGS. 2 and 3 described later. Note that the control device for the internal combustion engine corresponds to an electronic control unit (ECU) 20 that controls the internal combustion engine ENG.

In addition, although not illustrated, the internal combustion engine ENG is provided with a voltage sensor that measures a voltage on a primary side of the ignition coil 16 and a current sensor that measures a current on a secondary side. In addition, a cylinder head is provided with a variable valve 5 that adjusts the air-fuel mixture flowing into the cylinder or an exhaust gas discharged from the cylinder. The variable valve (variable valve 5) changes a timing at which an intake valve (intake valve 25) provided in the internal combustion engine (internal combustion engine ENG) operates. By adjusting the variable valve 5, the intake air amount and internal EGR gas amount of all cylinders are adjusted.

Further, the intake pipe is provided with a tumble control valve 8 whose opening degree is controlled by the ECU 20 as a valve that controls a flow velocity of the gas flowing into the cylinder of the internal combustion engine ENG. The tumble control valve 8 is in a fully closed state in a state st1 illustrated in the figure, and is in a fully opened state in a state st2. The opening degree of the tumble control valve 8 (referred to as "tumble control valve opening degree") is adjusted by the ECU 20. When the tumble control valve 8 is fully closed, the flow velocity of the intake air in which the air stored in the surge tank 6 flows into the cylinder from the intake pipe is accelerated. When the tumble control valve 8 is fully opened, the flow velocity of the intake air flowing into the cylinder from the intake pipe is decelerated. The tumble control valve (tumble control valve 8) changes the flow velocity of the gas flowing into the cylinder. Since the gas whose flow velocity is changed by the tumble control valve 8 flows into the cylinder, the air-fuel mixture in the cylinder tends to have a regular flow. Then, the ECU 20 controls the flow velocity of the gas flowing into the cylinder by adjusting the opening degree of the tumble control valve 8.

In addition, although not illustrated, a high-pressure fuel pump for supplying high-pressure fuel to the injector 13 is connected to the injector 13 by a fuel pipe. In addition, a fuel pressure sensor for measuring a fuel injection pressure is provided in the fuel pipe. In addition, a crank angle sensor 19 for detecting a piston position of the internal combustion engine ENG is attached to a crankshaft. Output information of the fuel pressure sensor and the crank angle sensor 19 is transmitted to the ECU 20.

Further, a turbine 4*b*, an electronically controlled wastegate valve 11, a three-way catalyst 10, and an air-fuel ratio sensor 9 provided in the internal combustion engine ENG are provided at the respective appropriate positions in the exhaust pipe 15.

The turbine 4*b* gives a rotational force to a compressor 4*a* of the supercharger by exhaust energy.

The electronically controlled wastegate valve 11 adjusts an exhaust flow rate flowing through the turbine 4*b*.

The three-way catalyst 10 purifies the exhaust gas.

The air-fuel ratio sensor 9 is an aspect of an air-fuel ratio detector, and detects an air-fuel ratio of the exhaust gas on an upstream side of the three-way catalyst 10.

In addition, the internal combustion engine ENG includes an EGR pipe 100 for recirculating the exhaust gas from a downstream side of the three-way catalyst 10 of the exhaust pipe to an upstream side of the compressor 4*a* of the intake pipe. In addition, an EGR cooler 102 for cooling the EGR gas and an EGR valve (EGR mechanism) 101 for controlling the EGR gas flow rate are attached to the respective appropriate positions of the EGR pipe 100.

In addition, the internal combustion engine ENG is provided with a temperature sensor 18 that measures a temperature of a cooling water circulating in the internal combustion engine ENG.

The output information obtained from the air flow sensor 1, the humidity sensors 3*a* and 3*b*, the temperature sensor 18, and the air-fuel ratio sensor 9 described above is transmitted to the ECU 20. In addition, the output information obtained from the accelerator opening degree sensor 12 is transmitted to the ECU 20. The accelerator opening degree sensor 12 detects the amount of depression of an accelerator pedal, that is, an accelerator opening degree.

The ECU 20 calculates required torque based on the output information of the accelerator opening degree sensor 12. That is, the accelerator opening degree sensor 12 is used as required torque detection sensor that detects the required torque for the internal combustion engine ENG. In addition, the ECU 20 calculates the rotation speed of the internal combustion engine ENG based on the output information of the crank angle sensor 19. The ECU 20 optimally calculates the main operating amounts of the internal combustion engine ENG such as an air flow rate, a fuel injection amount, an ignition timing, a fuel pressure, and an EGR gas flow rate based on the operating state of the internal combustion engine ENG obtained from the output information of the various sensors described above.

The fuel injection amount calculated by the ECU 20 is converted into a valve opening pulse signal and is transmitted to the injector 13. In addition, an ignition signal is transmitted to the ignition coil 16 so that the ignition is performed at the ignition timing calculated by the ECU 20. In addition, the throttle opening degree calculated by the ECU 20 is transmitted to the electronically controlled throttle 2 as a throttle drive signal.

The injector 13 injects fuel into the air that has flowed into the cylinder from the intake pipe via the intake valve 25 to form an air-fuel mixture. The air-fuel mixture explodes due to sparks generated from the ignition plug 17 at a predetermined ignition timing, and a combustion pressure thereof pushes down the piston to serve as a driving force for the internal combustion engine ENG. Further, the exhaust gas after the explosion is sent to the three-way catalyst 10 through the exhaust pipe 15, and exhaust components are purified in the three-way catalyst 10 and are discharged to the outside.

In such an internal combustion engine system, detailed internal configuration examples and operation examples will be described below.

FIG. 2 is a control block diagram illustrating an internal configuration example of the ECU 20.

The ECU 20 includes an input circuit 21, an input/output port 22, a CPU 23*a*, a ROM 23*b*, a RAM 23*c*, and an ignition control unit 24.

Input signals such as a primary voltage detected by the voltage sensor of the ignition coil 16, a secondary current detected by the current sensor of the ignition coil 16, accelerator depression information (accelerator opening degree) from the accelerator opening degree sensor 12, a rotation speed of internal combustion engine ENG, humidity information from the humidity sensors 3*a* and 3*b*, air amount information from the air flow sensor 1, and angle information (crank angle) from the crank angle sensor 19 are input to the input circuit 21 of the ECU 20. However, since the input signals are not limited thereto, the input signals will be added and described as appropriate.

The input signal of each sensor input to the input circuit 21 is transmitted to an input port in the input/output port 22. The input information transmitted to the input/output port 22 is temporarily stored in the RAM 23*c*, and is arithmetically processed by the CPU 23*a* according to a predetermined control program. The control program that describes the contents of the arithmetic processing is written in advance in the ROM 23*b*, and is appropriately read and executed by the CPU 23*a*.

The output information indicating the amount of operation to the injector 13 or the ignition coil 16 that controls the internal combustion engine ENG, which is calculated according to the control program, is temporarily stored in the RAM 23*c*. Thereafter, the output information is transmitted to an output port in the input/output port 22, and the injector 13, the ignition coil 16, or the like operates via the respective drive circuits. Note that actuators other than these are also used in the internal combustion engine ENG, but the description thereof will be omitted here.

In the present embodiment, the ignition control unit 24 is illustrated as the drive circuit of the ignition coil 16. The ignition control unit 24 controls the ignition energization time of the ignition coil 16, the supply energy supplied by the ignition plug 17 to the air-fuel mixture, or the like. In the present embodiment, the ECU 20 includes the ignition control unit 24, but the present invention is not limited to such a configuration. For example, a portion of the ignition control unit 24 or the entirety of the ignition control unit 24 may be mounted on a device different from the ECU 20.

Then, the ECU 20 calculates the supply energy of the ignition plug 17 according to the air amount, the crank angle, the cooling water temperature, the intake air temperature, the humidity, and the like detected by each sensor, and energizes the ignition coil 16 at an appropriate timing (ignition energization time or ignition timing) to ignite the air-fuel mixture in the cylinder.

FIG. 3 is a block diagram illustrating an internal configuration example of the ignition control unit 24 in the ECU 20 which is a control device of the internal combustion engine ENG. In the ignition control unit 24, the ignition timing and the ignition energization time are corrected in order to control the supply energy of the ignition plug 17. In the following description, the ignition control unit 24 operates in a unit of control in which a series of processing in each unit of the ignition control unit 24 is one cycle from the start to the end. Note that when the term "corresponding cycle" is used in the explanation, it means that the processing is performed within this one cycle.

The ignition control unit 24 includes a secondary voltage calculation unit 31, an irregular flow ratio calculation unit 32, an energy supply amount calculation unit 33, a target value calculation unit 34, an advance angle/energy correction determination unit 35, a supply energy correction unit 36, and an ignition operation amount correction unit 37.

The secondary voltage calculation unit (secondary voltage calculation unit 31) calculates an average value of a secondary voltage generated on a secondary side of the ignition coil (ignition coil 16). Therefore, the secondary voltage calculation unit 31 calculates a time average value of the voltage on the secondary side (secondary voltage) based on the detection value of the voltage sensor that measures the voltage on the primary side of the ignition coil 16. The time average value of the secondary voltage calculated by the secondary voltage calculation unit 31 is input to the irregular flow ratio calculation unit 32 and the energy supply amount calculation unit 33.

Figure 5:
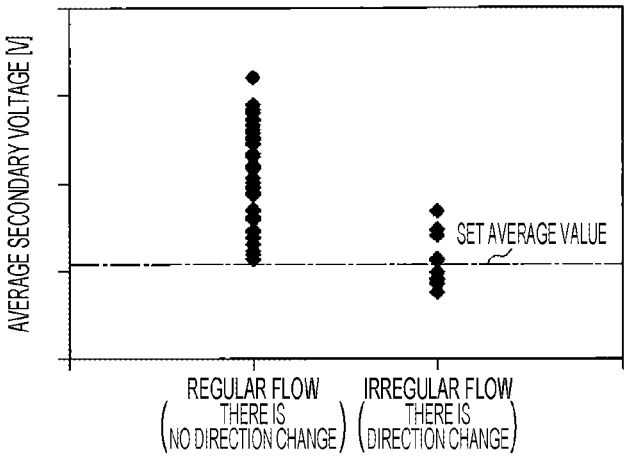
FIG. 5 is an explanatory diagram illustrating an example of a regular flow and an irregular flow in a cylinder according to the first embodiment of the present invention for each cycle.

The irregular flow ratio calculation unit (irregular flow ratio calculation unit 32) calculates a ratio of cycles in which the average value of the secondary voltage is equal to or less than a set average value as an irregular flow ratio indicating that the flow of the air-fuel mixture in the cylinder is irregular with respect to the cycle of the internal combustion engine (internal combustion engine ENG) in a predetermined period. At this time, the irregular flow ratio calculation unit 32 determines whether a direction of the tumble flow from the start to the end of ignition of the ignition plug 17 is regular, or irregular, that is, whether the direction of the tumble flow has changed based on a magnitude relationship between the time average value of the secondary voltage and the predetermined set average value. Then, the irregular flow ratio calculation unit 32 calculates the ratio of irregular cycles (irregular flow ratio). The irregular flow ratio is obtained, for example, from the ratio of cycles in which the average secondary voltage is equal to or less than the set average value as a determination criterion, as illustrated in FIG. 5 described later. The irregular flow ratio calculated by the irregular flow ratio calculation unit 32 is input to the advance angle/energy correction determination unit 35.

The energy supply amount calculation unit (energy supply amount calculation unit 33) calculates an energy supply amount of the supply energy supplied by the ignition plug (ignition plug 17) to the air-fuel mixture based on the average value of the secondary voltage calculated the secondary voltage calculation unit (secondary voltage calculation unit 31) and the secondary current of the ignition coil (ignition coil 16) detected by the current sensor attached to the ignition coil (ignition coil 16). In the calculation of the energy supply amount, a method of calculating the energy supply amount by integrating a product of a current measurement value (secondary current) and the secondary voltage on the secondary side of the ignition coil 16, or a method of calculating the energy supply amount based on a proportional relationship with an ignition energization time (Dwell) is used. The energy supply amount calculated by the energy supply amount calculation unit 33 is input to the advance angle/energy correction determination unit 35.

The target value calculation unit (target value calculation unit 34) calculates a target value of the irregular flow ratio (irregular flow ratio R) based on an operating state of the internal combustion engine (internal combustion engine ENG). Here, the target value of the irregular flow ratio (irregular flow ratio R) includes a set ratio value (set ratio value Tr). In addition, the target value of the irregular flow ratio (irregular flow ratio R) includes a set supply energy representing the supply energy supplied by the ignition plug (ignition plug 17) to the air-fuel mixture at the set ratio value (set ratio value Tr). Therefore, the required torque calculated from the accelerator opening degree, the rotation speed of the internal combustion engine ENG, the intake valve timing, and the tumble control valve opening degree are input to the target value calculation unit 34. Then, the target value calculation unit 34 calculates the irregular flow ratio (set ratio value of the irregular flow ratio), which is a target to be reached, and the set supply energy at the irregular flow ratio, which is the target to be reached, as target values based on such input information. The set ratio value of the irregular flow ratio and the set supply energy calculated by the target value calculation unit 34 are input to the advance angle/energy correction determination unit 35.

Figure 13:
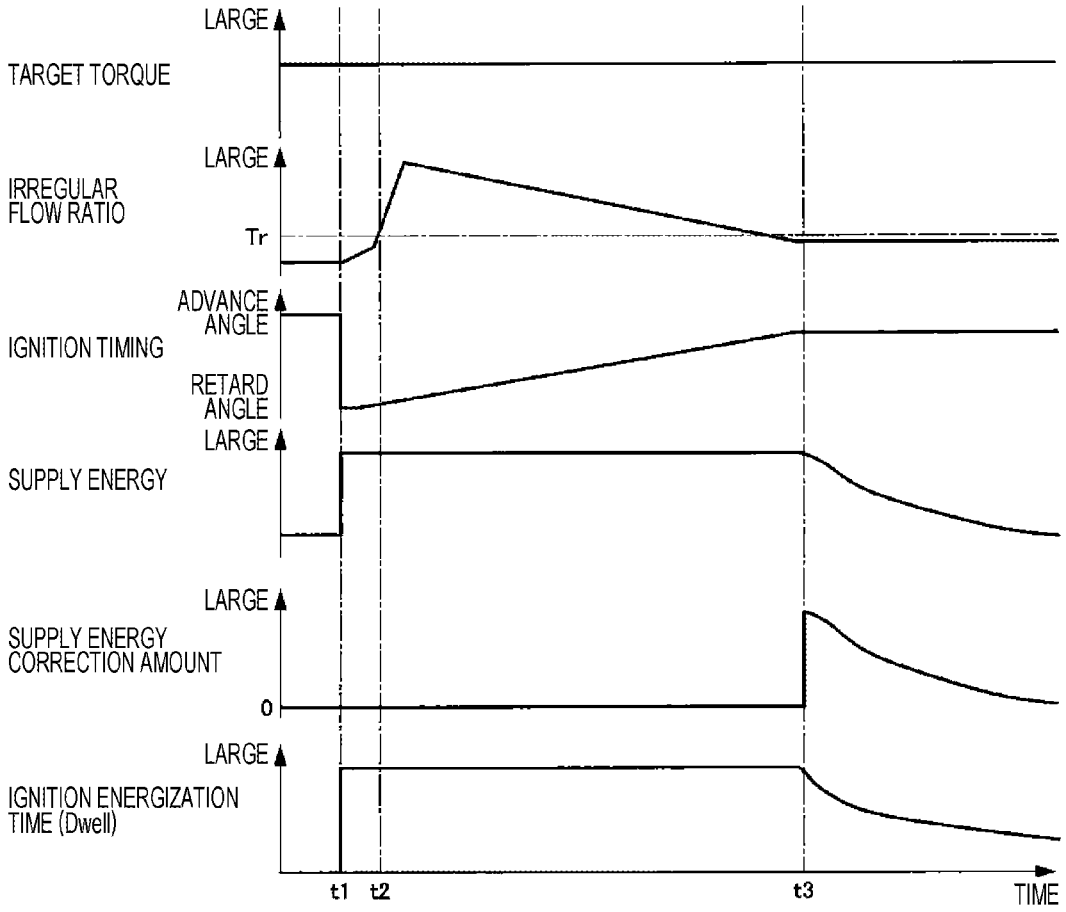
FIG. 13 is a timing chart representing a relationship between a value calculated by the ignition control unit and an ignition operation amount according to the first embodiment of the present invention.

The correction determination unit (advance angle/energy correction determination unit 35) determines whether or not the ignition operation amount is corrected based on the irregular flow ratio (irregular flow ratio R), the energy supply amount, and the target value (set ratio value Tr) of the irregular flow ratio (irregular flow ratio R). At this time, the advance angle/energy correction determination unit 35 determines whether to perform advance angle control of the ignition timing or to perform reduction correction of the supply energy based on the irregular flow ratio, the energy supply amount, and the set ratio value Tr of the irregular flow ratio which are input. If the irregular flow ratio is lower than the set ratio value Tr as illustrated in FIG. 13 described later, the advance angle/energy correction determination unit 35 does nothing, but if the irregular flow ratio is higher than the set ratio value Tr, it is determined that the advance angle control or the reduction correction of the supply energy is performed by the advance angle/energy correction determination unit 35. The determination result by the advance angle/energy correction determination unit 35 is input to the supply energy correction unit 36 and the ignition operation amount correction unit 37.

When the correction determination unit (advance angle/energy correction determination unit 35) determines that the correction to reduce the supply energy is performed, the supply energy correction unit (supply energy correction unit 36) calculates the supply energy correction amount for performing the correction for reducing the supply energy, and outputs the supply energy correction amount to the ignition operation amount correction unit (ignition operation amount correction unit 37). Here, the supply energy correction unit 36 calculates a reduction correction amount of the supply energy (a supply energy correction amount ΔE illustrated in step S11 of FIG. 4 to be described later) based on the determination result input from the advance angle/energy correction determination unit 35. Further, the supply energy correction unit 36 calculates a correction supply energy of the corresponding cycle (correction supply energy Etar illustrated in step S12 of FIG. 4 to be described later). The correction supply energy calculated by the supply energy correction unit 36 is input to the ignition operation amount correction unit 37.

The ignition operation amount correction unit (ignition operation amount correction unit 37) corrects the ignition operation amount so that the irregular flow ratio (irregular flow ratio R) is less than or equal to the set ratio value (set ratio value Tr) that is the target to be reached of the irregular flow ratio (irregular flow ratio R). Therefore, in addition to the determination result by the advance angle/energy correction determination unit 35 and the correction supply energy calculated by the supply energy correction unit 36, the ignition timing and the ignition energization time used as the ignition operation amount are input to the ignition operation amount correction unit 37. Then, the ignition operation amount correction unit (ignition operation amount correction unit 37) corrects the ignition operation amount when the correction determination unit (advance angle/energy correction determination unit 35) determines that the ignition operation amount is corrected. Since the ignition operation amount correction unit 37 corrects the ignition operation amount only when it is determined that the ignition operation amount is corrected in this way, the ignition operation amount correction unit 37 does not have to operate when it is determined that the ignition operation amount correction is not performed.

Here, the ignition operation amount correction unit (ignition operation amount correction unit 37) corrects the ignition timing of the ignition plug (spark plug 17) to the advance angle when the irregular flow ratio (irregular flow ratio R) exceeds the set ratio value (set ratio value Tr). In addition, the ignition operation amount correction unit (ignition operation amount correction unit 37) corrects the ignition energization time for energizing the primary side of the ignition coil (ignition coil 16). In this way, the ignition operation amount correction unit 37 calculates the ignition advance angle amount, corrects the ignition timing, and corrects the ignition energization time (Dwell), based on the input determination result and correction supply energy. Note that the ignition operation amount correction unit 37 may perform either the advance angle control of the ignition timing or the reduction correction of the supply energy. Thereafter, the ignition operation amount correction unit 37 outputs correction values of the corrected ignition timing (correction ignition timing) and the ignition energization time to the ignition coil 16, and the operation of the ignition coil 16 is controlled.

Here, the supply energy correction unit (supply energy correction unit 36) calculates a difference between the set supply energy and the supply energy as the supply energy correction amount when the irregular flow ratio (irregular flow ratio R) is equal to or less than the set ratio value (set ratio value Tr). The ignition operation amount correction unit (ignition operation amount correction unit 37) reduces the supply energy based on the supply energy correction amount input from the supply energy correction unit (supply energy correction unit 36). Therefore, a heat generation of the ignition coil 16 is suppressed, and wear of the ignition plug 17 can be suppressed.

Figure 4:
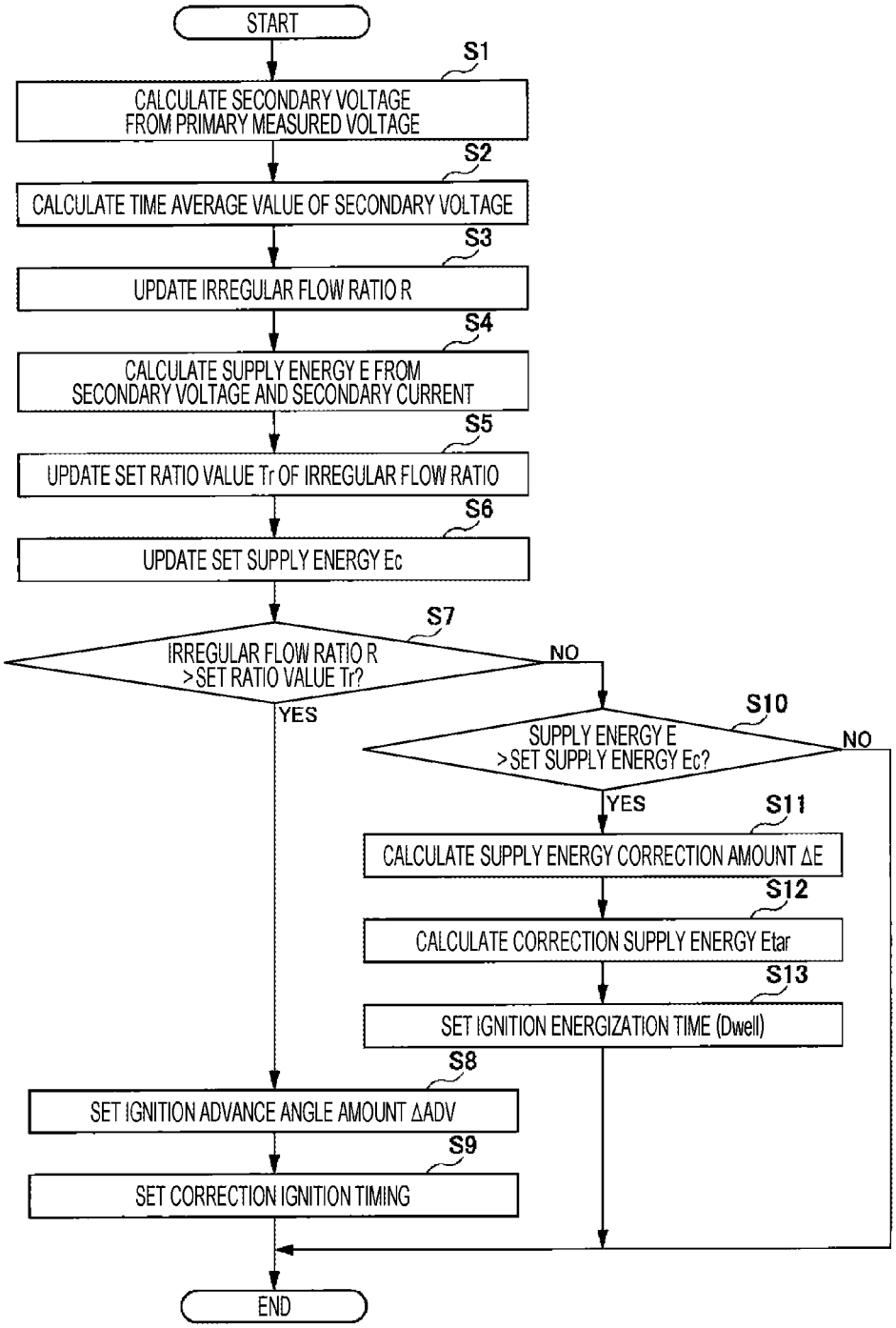
FIG. 4 is a flowchart illustrating an example of processing executed by each control block in the ignition control unit according to the first embodiment of the present invention.

FIG. 4 is a flowchart illustrating an example of processing executed by each control block in the ignition control unit 24. The details of the processing executed in each control block will be described with reference to the present flowchart.

First, the secondary voltage calculation unit 31 calculates a secondary voltage from a primary voltage measured by the voltage sensor (S1). When a voltage measured by dividing the voltage on the primary side is Vm, a ratio of a measuring unit is r1 as a whole, and a coil turns ratio (number of turns on the secondary side/number of turns on the primary side) is Nc, the secondary voltage is obtained by the following Equation (1).

$$V2(t)=Vm(t)/r1\times Nc \tag{1}$$

t represents time and V2(*t*) means that the secondary voltage is a function of time. If the secondary voltage calculation unit 31 obtains the secondary voltage, the processing proceeds to step S2.

Next, the irregular flow ratio calculation unit 32 calculates a time average value of the secondary voltage (S2). An average value Vave of the secondary voltage can be obtained by the following Equation (2), where T is an integration section.

$$V\text{ave}=1/T\times\int V2(t)dt \tag{2}$$

The integration section T can be changed according to the operating conditions or the flow conditions. Since a discharge period of the ignition plug 17 tends to be short under the condition that the pressure in the cylinder is high, the integration section T can be reduced as a load of the internal combustion engine ENG increases. If the irregular flow ratio calculation unit 32 calculates the time average value of the secondary voltage, the processing proceeds to step S3.

Next, the irregular flow ratio calculation unit 32 compares the calculated time average value Vave of the secondary voltage with a reference value (set average value), and determines whether the flow of the corresponding cycle is regular or irregular, and updates the irregular flow ratio R (S3). Here, the regular flow and the irregular flow will be described with reference to FIG. 5.

FIG. 5 is an explanatory diagram illustrating an example of a regular flow and an irregular flow in the cylinder for each cycle. A vertical axis in the figure represents an average secondary voltage [V]. In addition, a horizontal axis represents a state of the average secondary voltage for each cycle for each regular flow and irregular flow.

In FIG. 5, an average secondary voltage when there is no direction change during discharging (regular flow) and an average secondary voltage when there is a direction change during discharging (irregular flow) are illustrated as measurement results for each cycle. The average secondary voltage of the irregular flow has a relatively small value as compared with the case of the regular flow because it has an effect of suppressing an elongation of the discharge path.

Therefore, an appropriate set average value is set to distinguish between the regular flow and the irregular flow. Then, the irregular flow ratio calculation unit 32 determines that a cycle in which the average secondary voltage is lower than the set average value is a cycle of the irregular flow. In this way, by observing a relationship between the average secondary voltage value and the set average value, it is possible to easily determine whether or not the flow during the discharge period is irregular.

Here, the irregular flow ratio calculation unit 32 stores, for example, the number of cycles Ni in which the irregular flow has occurred in the past Nall cycle (about 50 cycles) as the irregular flow ratio R, and obtains the irregular flow ratio R using the following Equation (3).

$$R=Ni/N\text{all} \tag{3}$$

Alternatively, the irregular flow ratio calculation unit 32 updates the irregular flow ratio R by the following Equation (4) using a weighting coefficient w.

$$R=(R\times w\times N\text{all}+1)/(w\times N\text{all}+1) \tag{4}$$

The weighting coefficient w is a value determined in advance based on experiments or simulations, and is a value greater than 0 and less than or equal to 1. After the irregular flow ratio calculation unit 32 updates the irregular flow ratio R, the processing proceeds to step S4.

Next, the energy supply amount calculation unit 33 obtains a supply energy E from a secondary voltage calculated value V2(*t*) and a secondary current measured value I2(*t*) by the following Equation (5) (S4).

$$E=\int V2(t)I2(t)dt \tag{5}$$

After the energy supply amount calculation unit 33 obtains the supply energy E, the processing proceeds to step S5.

Next, the target value calculation unit 34 updates the set ratio value Tr of the irregular flow ratio (S5). The setting ratio value Tr of the irregular flow ratio changes according to the operating conditions. The irregularity of the flow in the cylinder is that the regular flow (tumble flow) formed in the cylinder collapses (tumble collapse), and the irregular flow becomes remarkable. The tumble collapse occurs when a volume inside the cylinder becomes small and the regular flow cannot be maintained. Therefore, the irregular flow ratio R is greatly affected by the strength and volume of the tumble formed in the cylinder.

By having the irregular flow ratio under a steady control adaptation condition as a map centered on the rotation speed and the torque, the set ratio value Tr of the irregular flow ratio under the operating conditions can be calculated from the input required torque degree and rotation speed and the map during the operation of the internal combustion engine ENG.

Figure 6:
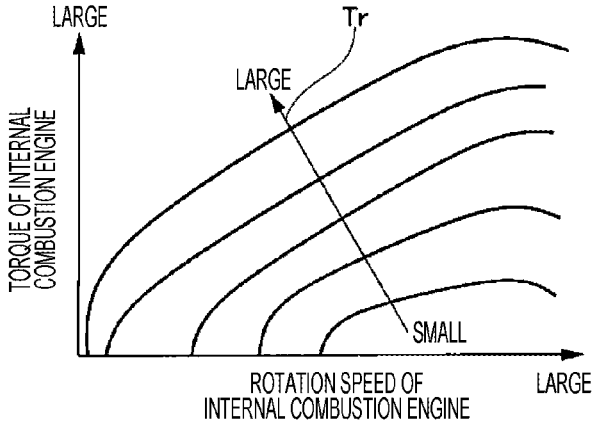
FIG. 6 is an explanatory diagram illustrating a relationship between a rotation speed and torque of the internal combustion engine according to the first embodiment of the present invention.

FIG. 6 is an explanatory diagram illustrating a relationship between the rotation speed and the torque of the internal combustion engine ENG.

It is assumed that the ignition timing is set in an advance angle direction as the rotation speed of the internal combustion engine ENG increases, and the ignition timing is set in a retard angle direction as the torque of the internal combustion engine ENG increases.

In this case, as illustrated by an arrow Tr in FIG. 6, when the internal combustion engine ENG has a low load and high rotation, the set ratio Tr of the irregular flow ratio becomes low, and when the internal combustion engine ENG has a high load and low rotation, the set ratio Tr of the irregular flow ratio tends to be high. Therefore, the target value calculation unit (target value calculation unit 34) sets the set ratio value (set ratio value Tr) to be smaller, as the rotation speed of the internal combustion engine (internal combustion engine ENG) is higher and the torque of the internal combustion engine (internal combustion engine ENG) is smaller, and sets the set ratio value (set ratio value Tr) to be larger, as the rotation speed of the internal combustion engine (internal combustion engine ENG) is smaller and the torque of the internal combustion engine (internal combustion engine ENG) is larger. By determining the set ratio value of Tr the irregular flow ratio in this way, an appropriate set value of the irregular flow ratio can be defined according to the operating conditions, and appropriate control according to each operating condition becomes possible.

In addition, the set ratio value Tr of the irregular flow ratio can be corrected according to the setting of the variable valve 5 and can also be corrected according to the setting of the tumble control valve 8. The correction according to these settings will be described with reference to FIGS. 7 and 8.

FIG. is an explanatory diagram illustrating a relationship between an intake valve closing timing and an irregular flow ratio magnification RI.

As an intake valve closing timing advances due to the control of the variable valve 5, a flow evaluated at the same crank angle is attenuated. Therefore, the irregular flow ratio R tends to increase as the intake valve closing timing advances. Therefore, the target value calculation unit (target value calculation unit 34) sets the set ratio value (set ratio value Tr) to be larger as a closing timing of the intake valve (intake valve 25) advances due to the operation of the variable valve (variable valve 5). In order to set the set ratio value Tr in this way, an irregular flow ratio magnification RI, which is a magnification from the irregular flow ratio R related to the intake valve 25, is provided. The set ratio value Tr can be greatly changed by the irregular flow ratio magnification RI.

Figure 7:
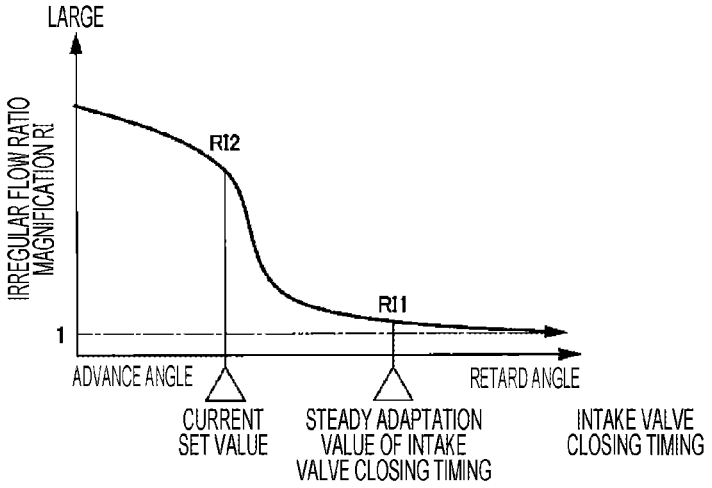
FIG. 7 is an explanatory diagram illustrating a relationship between an intake valve closing timing and an irregular flow ratio magnification according to the first embodiment of the present invention.

For example, compared to an irregular flow ratio magnification RI2 at the current set value (called the "current set value") of the intake valve closing timing, which is the advance angle, an irregular flow ratio magnification RI1 at a steady adaptation value of the intake valve closing timing, which is a retard angle, is small. Therefore, the relationship between the irregular flow ratio magnification RI, which is the magnification from the irregular flow ratio R at a reference valve position, and the intake valve closing timing is mapped as illustrated in FIG. 7.

Then, using the irregular flow ratio magnification RI1 at the steady adaptation value of the intake valve closing timing and the irregular flow ratio magnification RI2 at the current set value, the target value calculation unit 34 corrects and updates the setting ratio value Tr of the irregular flow ratio by the following Equation (6).

$$Tr=Tr\times RI2/RI1 \quad (6)$$

Figure 8:
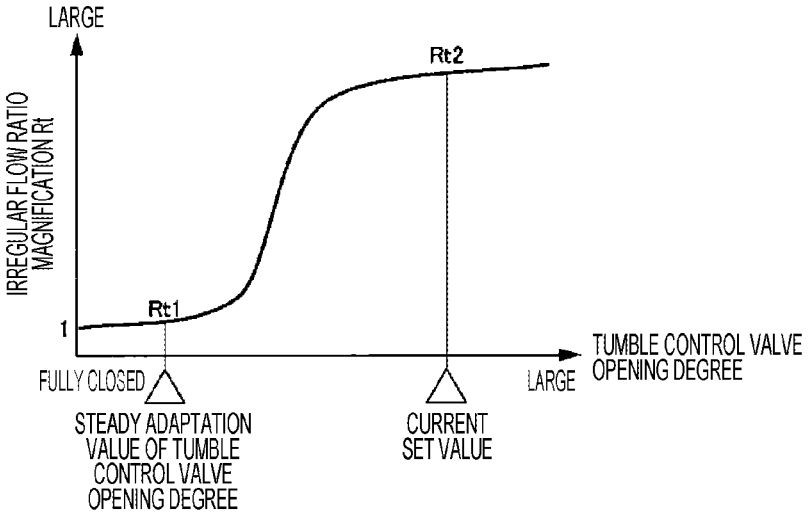
FIG. 8 is an explanatory diagram illustrating a relationship between a tumble control valve opening degree and an irregular flow ratio magnification according to the first embodiment of the present invention.

FIG. 8 is an explanatory diagram illustrating a relationship between a tumble control valve opening degree and an irregular flow ratio magnification Rt.

As the tumble control valve opening degree becomes smaller, a tumble flow evaluated at the same crank angle becomes faster, so that the smaller the opening degree of the tumble control valve, the smaller the irregular flow ratio tends to be. Therefore, the target value calculation unit (target value calculation unit 34) sets the set ratio value (set ratio value Tr) to be smaller as the opening degree of the tumble control valve (tumble control valve 8) becomes smaller. In order to set the set ratio value Tr in this way, an irregular flow ratio magnification Rt, which is a magnification of the irregular flow ratio R related to the tumble control valve 8, is provided. The set ratio value Tr can be greatly changed by the irregular flow ratio magnification Rt.

For example, the irregular flow ratio magnification Rt2 at the current set value where the tumble control valve opening is large is larger than an irregular flow ratio magnification Rt1 at the steady adaptation value of the tumble control valve opening degree near fully closed. Therefore, the relationship between the irregular flow ratio magnification Rt, which is the magnification from the irregular flow ratio R when the tumble control valve is fully closed, and the tumble control valve opening degree is mapped as illustrated in FIG. 8.

Then, using the magnification Rt1 at the steady adaptation value of the tumble control valve opening degree and the current set value Rt2, the target value calculation unit 34 corrects and updates the set ratio value Tr of the irregular flow ratio by the following Equation (7).

$$Tr=Tr\times Rt2/Rt1 \quad (7)$$

As illustrated in the above Equations (6) and (7), the target value calculation unit 34 corrects and updates the set ratio value Tr of the irregular flow ratio, so that the ECU 20 can be controlled in consideration of the intake valve timing or the tumble flow state that changes depending on the set value of the tumble control valve. If the target value calculation unit 34 determines the setting ratio value Tr of the irregular flow ratio, the processing proceeds to step S6.

Next, the target value calculation unit 34 updates a set supply energy Ec (S6). Here, information related to the set supply energy Ec will be described with reference to FIGS. 9 to 11, and further, a method of setting the set supply energy Ec will be described with reference to FIG. 12.

Figure 9:
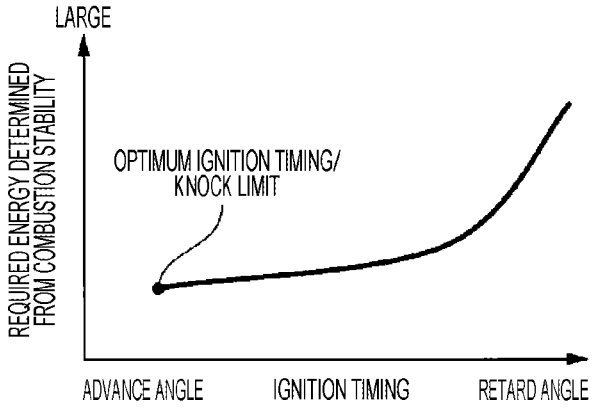
FIG. 9 is an explanatory diagram illustrating a relationship between a required energy determined from combustion stability and an ignition timing when the ignition timing of an ignition plug is changed under the conditions of the same torque and the same rotation speed of the internal combustion engine according to the first embodiment of the present invention.

FIG. 9 is an explanatory diagram illustrating a relationship between a required energy determined from the combustion stability and an ignition timing when the ignition timing of the ignition plug 17 is changed under the conditions of the same torque and the same rotation speed of the internal combustion engine ENG. A horizontal axis of FIG. 9 represents the ignition timing, and a vertical axis thereof represents the required energy determined from the combustion stability.

From FIG. 9, it is illustrated that the required energy obtained from the combustion stability tends to increase as the ignition timing changes from an optimum ignition timing or a knock limit ignition timing to a retard angle. In this way, as the ignition timing is retarded, the required energy determined from the combustion stability of the air-fuel mixture increases as compared with the set supply energy at the optimum ignition timing when the ignition timing of the ignition plug (ignition plug 17) is at the advance angle.

Figure 10:
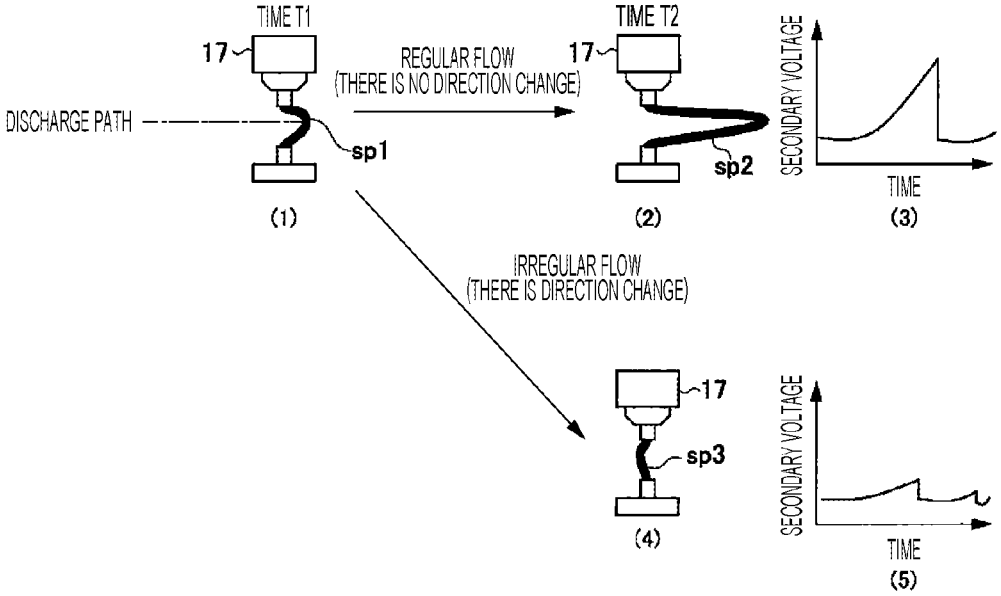
FIG. 10 is an explanatory diagram illustrating the movement of a discharge path generated around the ignition plug and a state of change in a secondary voltage according to the first embodiment of the present invention.

FIG. 10 is an explanatory diagram illustrating a movement of a discharge path generated around the ignition plug 17 and a change in the secondary voltage.

The ignition plug 17 ignites the air-fuel mixture by applying a high voltage between electrodes separated by a predetermined distance to discharge the electrodes. At this time, a supply energy is applied to the air-fuel mixture from the discharge path. In an explanatory diagram (1) of the ignition plug 17 illustrated in FIG. 10, a state of the discharge generated between the electrodes of the ignition plug 17 at the time T1 is represented by a discharge path sp1.

In an explanatory diagram (2) of the ignition plug 17, a state of the discharge generated between the electrodes of the ignition plug 17 at time T2 is represented by a discharge path sp2. If there is no change in the flow direction during discharging, the discharge path sp2 is significantly elongated.

A graph (3) represents a time change of the secondary voltage when there is no change in the flow direction during discharging. The graph (3) illustrates that the secondary voltage increases as the discharge path sp2 is significantly elongated. When the secondary voltage is increased in this way, the amount of energy supplied to the air-fuel mixture is increased, so that the combustion is likely to be stable.

On the other hand, in an explanatory diagram (4) of the ignition plug 17, a state of the discharge generated between the electrodes of the ignition plug 17 at the same time T2 is represented by a discharge path sp3. When there is a change in the flow direction during discharging, the elongation of the discharge path sp3 is suppressed due to the change in the flow.

A graph (5) represents a time change of the secondary voltage when there is a change in the flow direction during discharging. The graph (5) illustrates that an increase in the secondary voltage is also suppressed by suppressing the elongation of the discharge path sp3. When the secondary voltage does not increase in this way, the amount of energy supplied to the air-fuel mixture is relatively small compared to the regular flow, so that the combustion is likely to be unstable.

Figure 11:
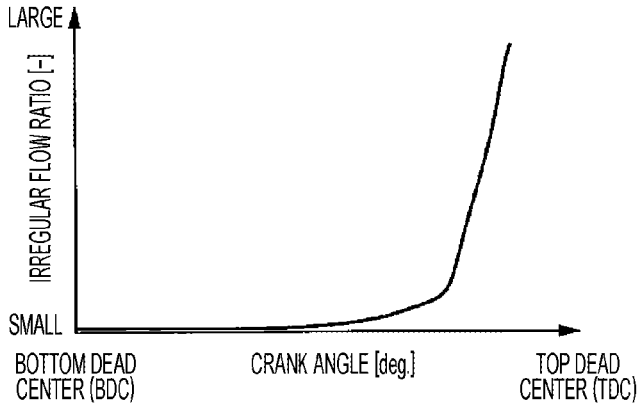
FIG. 11 is an explanatory diagram representing the ignition timing of the ignition plug and an occurrence rate of irregular flow (irregular flow ratio) according to the first embodiment of the present invention.

FIG. 11 is an explanatory diagram representing the ignition timing of the ignition plug 17 and an occurrence rate of irregular flow (irregular flow ratio). A horizontal axis of FIG. 11 represents a crank angle, and a vertical axis represents an irregular flow ratio.

The movement of the piston moving from a bottom dead center (BDC) to a top dead center (TDC) is represented by the crank angle [deg.]. When the piston is near the bottom dead center, the irregular flow ratio R takes a small value, but as the piston moves toward the top dead center, the irregular flow ratio R takes a large value. Therefore, when the ignition timing is retarded, the occurrence rate of irregular flow in which the amount of energy supplied to the air-fuel mixture is reduced increases. As a result, the supply energy required for stable combustion increases under the ignition retard condition.

Here, the set supply energy Ec is the smallest required energy under the conditions of the same torque and the same rotation speed. Therefore, the set supply energy Ec is equivalent to the energy required for stable combustion at the optimum ignition timing or the knock limit ignition timing illustrated in FIG. 9. Therefore, the set supply energy Ec is given by a map centered on the required torque and the rotation speed. Then, the target value calculation unit 34 can calculate the set supply energy Ec based on the required torque and the rotation speed. If the target value calculation unit 34 updates the set supply energy Ec, the processing proceeds to step S7.

Next, the advance angle/energy correction determination unit 35 determines whether the calculated value R of the irregular flow ratio exceeds the set ratio value Tr of the irregular flow ratio (S7). If the advance angle/energy correction determination unit 35 determines that the calculated value R of the irregular flow ratio exceeds the set ratio value Tr of the irregular flow ratio (Yes in S7), the processing proceeds to step S8. On the other hand, if the advance angle/energy correction determination unit 35 determines that the calculated value R of the irregular flow ratio is equal to or less than the set ratio value Tr of the irregular flow ratio (No in S7), the processing proceeds to step S10.

After the Yes determination in step S7, the ignition operation amount correction unit 37 sets the ignition advance angle amount ΔADV (S8). An adaptation value of the advance angle amount [deg.] or the advance angular velocity [deg./ms] per cycle is given by, for example, a fixed value ΔADVref. Then, the ignition operation amount correction unit 37 calculates the ignition advance angle amount ΔADV by the following Equation (8). In the first embodiment, the ignition advance angle amount ΔADV is a value determined by a map prepared in advance. After calculating the ignition advance angle amount ΔADV, the processing proceeds to step S9.

$$\Delta ADV = \Delta ADVref \tag{8}$$

Next, the ignition operation amount correction unit 37 sets a correction ignition timing calculated by the following Equation (9) based on the ignition advance angle amount ΔADV [deg.] determined in step S8 and a default value ADV of the ignition timing [deg.ATDC] (S9).

$$ADV = ADV - \Delta ADV \tag{9}$$

By setting the correction ignition timing in this way, the ignition operation amount correction unit 37 can perform advance angle control under the condition that the irregular flow ratio R is high. As a result, since the ignition timing is changed to a condition in which the irregular flow ratio R in the discharge period is low, a more stable combustion state can be obtained. Then, after step S9, the present processing ends.

On the other hand, after the No determination in step S7, the advance angle/energy correction determination unit 35 determines whether the supply energy E exceeds the set supply energy Ec (S10). If the advance angle/energy correction determination unit 35 determines that the supply energy E exceeds the set supply energy Ec (Yes in S10), the processing proceeds to step S11. On the other hand, when the advance angle/energy correction determination unit 35 determines that the supply energy E is equal to or less than the set supply energy Ec (No in S10), the processing ends.

After the Yes determination in step S10, the supply energy correction unit 36 calculates a supply energy correction amount ΔE based on the supply energy E and the set supply energy Ec (S11). The supply energy correction amount ΔE is used to make a correction for reducing the supply energy E. Then, in order to gradually bring the supply energy E to approach the set supply energy Ec, the supply energy correction unit 36 calculates the supply energy correction amount ΔE by, for example, the following Equation (10).

$$\Delta E=(E-Ec)/\text{Niter} \quad (10)$$

Niter is a variable that defines a speed of gradually approaching the set value and is a real number greater than 1.

After the supply energy correction unit 36 calculates the supply energy correction amount ΔE, the processing proceeds to step S12.

Next, the supply energy correction unit 36 calculates a correction supply energy Etar based on the supply energy E and the supply energy correction amount ΔE obtained in step S9 (S12). The correction supply energy Etar is calculated using, for example, the following Equation (11).

$$\text{Etar}=E-\Delta E \quad (11)$$

After the supply energy correction unit 36 calculates the correction supply energy Etar, the processing proceeds to step S13.

By calculating the correction supply energy Etar by the supply energy correction unit 36 in this way, the supply energy can be reduced according to a decrease in the irregular flow ratio R. As a result, excess energy consumption and heat generation generated by the ignition plug 17 can be reduced, and deterioration prevention or failure prevention of the ignition plug 17 can be realized.

Next, the ignition operation amount correction unit 37 sets an ignition energization time (Dwell) for reducing the supply energy based on the correction supply energy Etar obtained in step S12 (S13). The relationship between the ignition energization time and the supply energy is determined according to the characteristics of the ignition coil 16. Therefore, the ignition operation amount correction unit 37 has a relationship between the ignition energization time and the supply energy as a map, and determines the ignition energization time from such a relationship. The larger the supply energy, the longer the ignition energization time. By setting the ignition energization time by the ignition operation amount correction unit 37 in this way, the ignition plug 17 generates the supply energy corresponding to the correction supply energy Etar in the coil control of the ignition coil 16.

Figure 12:
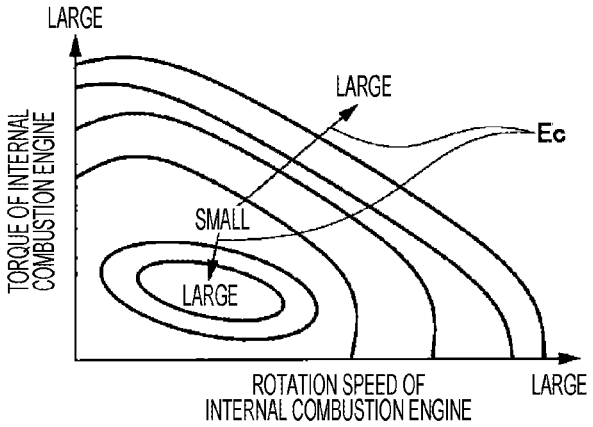
FIG. 12 is an explanatory diagram illustrating an example of set supply energy that changes according to the rotation speed and torque of the internal combustion engine according to the first embodiment of the present invention.

FIG. 12 is an explanatory diagram illustrating an example of a set supply energy Ec that changes according to the rotation speed and the torque of the internal combustion engine ENG. In this explanatory diagram, a horizontal axis represents the rotation speed of the internal combustion engine ENG, and a vertical axis represents the torque of the internal combustion engine ENG. In the figure, the set supply energy Ec is represented by an arrow.

The place where the set supply energy Ec is represented as "small" indicates that the set supply energy Ec is optimal. Since the pressure in the cylinder decreases and it becomes difficult to ignite the air-fuel mixture when the torque of the internal combustion engine ENG decreases, control is performed to change the set supply energy Ec to "large". On the other hand, since the amount of the air-fuel mixture sucked into the cylinder also increases even when the torque of the internal combustion engine ENG increases and the rotation speed of the internal combustion engine ENG increases, control is performed to change the set supply energy Ec to "large".

Next, the timings at which various values calculated by the ignition control unit 24 according to the present embodiment change will be described.

FIG. 13 is a timing chart representing a relationship between the value calculated by the ignition control unit 24 and the ignition operation amount according to the present embodiment. An operation example and an effect of the ignition control unit 24 according to the first embodiment will be described with reference to FIG. 13.

(Initial State)

First, the irregular flow ratio R is lower than the set ratio value Tr of the irregular flow ratio. In addition, the ignition timing is carried out at an advance angle, and the supply energy is in a low state. In addition, the supply energy correction amount is zero, and the ignition energization time (Dwell) is also zero. Note that the target torque is constant regardless of a time lapse.

(Time t1)

From time t1, it is assumed that ignition retard control is performed due to a knock occurrence or other factors under the condition that the target torque is constant. The ignition timing, which was the advance angle, is changed in a retard angle direction at time t1. As a result, the irregular flow ratio R begins to increase. In addition, the ignition energization time is set to "large". As illustrated in FIG. 9, when the ignition timing is performed at a retarded angle, the required energy increases. Therefore, the supply energy is also controlled to increase in accordance with the control performed when the ignition timing is retarded.

(Time t2)

In the present embodiment, the irregular flow ratio R exceeds the set ratio value Tr of the irregular flow ratio at time t2. At this timing, control with the ignition timing as the advance angle is started through the determination processing in step S7 of FIG. 4 (S8, S9). As the ignition timing is controlled in the advance angle direction, the irregular flow ratio R decreases.

(Time t3)

From time t3, the irregular flow ratio R continues to be lower than the set ratio value Tr of the irregular flow ratio. After the time t3, as illustrated in the processing of steps S10 to S13 in FIG. 4, the supply energy correction amount ΔE changes so as to reduce and correct the supply energy, and the ignition energization time gradually decreases. In addition, at the time t3, the supply energy correction amount ΔE increases, so that the supply energy E decreases and the ignition energization time also gradually decreases.

In the ECU 20 according to the first embodiment described above, the supply energy supplied to the air-fuel mixture in the cylinder is predicted in consideration of the irregular flow ratio R related to the change in the flow of the air-fuel mixture in the cylinder by the processing performed by the ignition control unit 24 illustrated in FIG. 3. Then, the ignition control unit 24 operates the ignition operation amount including at least one of the ignition timing and the ignition energization time so that the ignition control unit 24 reduces the supply energy E. As a result, the supply energy decreases under the condition that the irregular flow ratio R is equal to or less than the set ratio value Tr, that is, the supply energy required for stable combustion becomes small. By controlling the supply energy according to the irregular flow ratio R in this way, it is possible to suppress heat generation of the ignition coil 16 and wear of the ignition plug 17, and improve the durability of the internal combustion engine system.

Note that the engine EGN adopted a form in which the injector 13 injects fuel directly into the cylinder, but an engine in which the fuel injected by the injector provided in the intake pipe is sucked into the cylinder together with gas may be adopted.

In addition, the engine EGN has a form in which the tumble control valve 8 is provided in the intake pipe, but a form in which the tumble control valve 8 is removed may be adopted.

In addition, an engine in which the EGR gas is not used for intake air may be adopted.

Second Embodiment

Next, a control example performed by the ECU 20 according to a second embodiment of the present invention will be described. The configuration of the ECU 20 according to the second embodiment is the same as the configuration of the ECU 20 according to the first embodiment described with reference to FIGS. 1 and 2. Therefore, a configuration example and an operation example of the ECU 20 according to the second embodiment will be described with reference to FIGS. 14 to 17.

Figure 14:
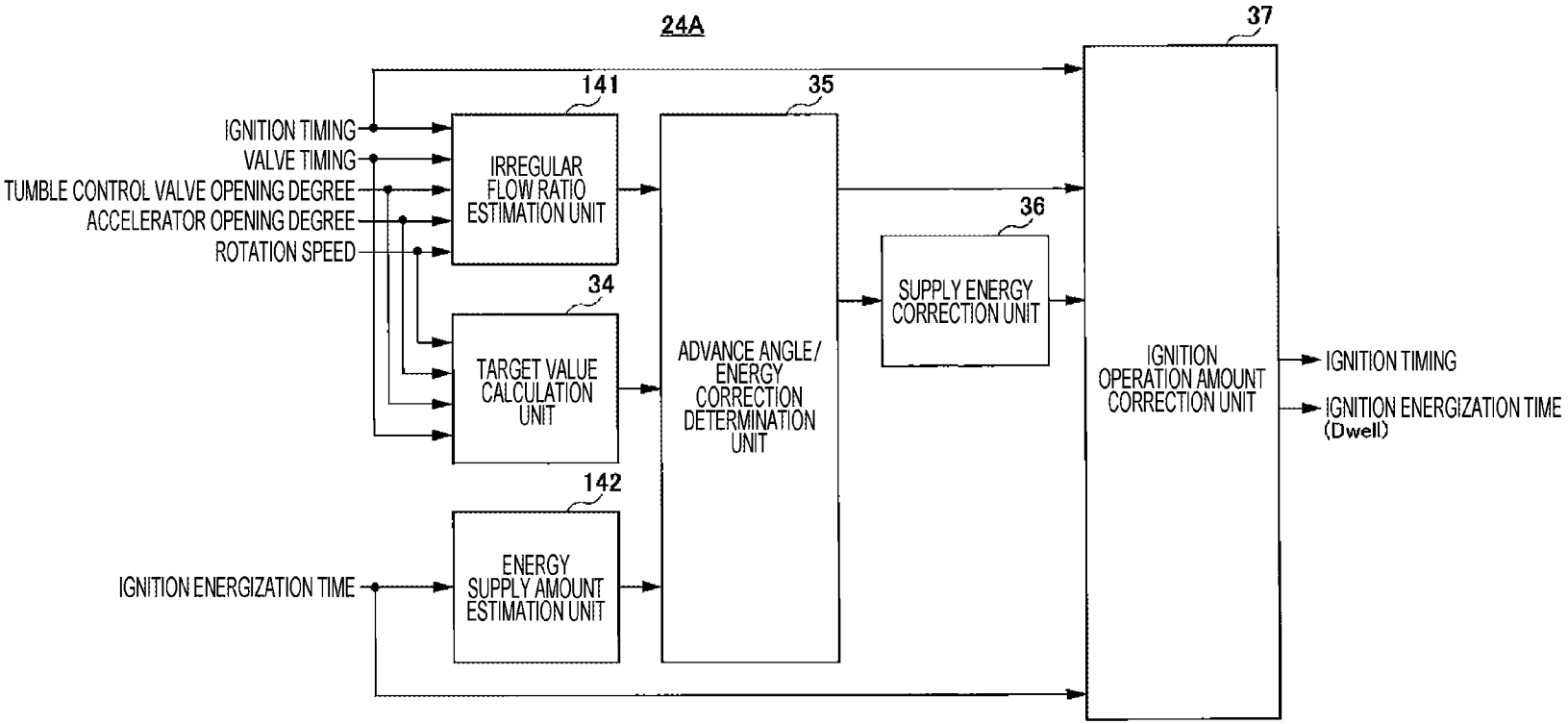
FIG. 14 is a block diagram illustrating an internal configuration example of an ignition control unit included in an ECU which is a control device of an internal combustion engine according to a second embodiment of the present invention.

FIG. 14 is a block diagram illustrating an internal configuration example of an ignition control unit 24A included in the ECU 20 which is a control device for the internal combustion engine ENG. The control device according to the present embodiment includes an ignition control unit (ignition control unit 24A) that supplies a primary voltage to a primary side of the ignition coil (ignition coil 16) provided in the internal combustion engine (internal combustion engine ENG) according to a predetermined ignition operation amount, discharges the ignition plug (ignition plug 17) provided in the internal combustion engine (internal combustion engine ENG), and controls an ignition of the air-fuel mixture in which the gas sucked into the cylinder of the internal combustion engine (internal combustion engine ENG) and the fuel are mixed, and controls the internal combustion engine (internal combustion engine ENG). In the ignition control unit 24A as well, in order to control the supply energy of the ignition plug 17, the ignition operation amount including at least one of the ignition timing of the ignition plug 17 and the ignition energization time of the ignition coil 16 is corrected.

The ignition control unit 24A has a configuration in which the irregular flow ratio calculation unit 32 is replaced with an irregular flow ratio estimation unit 141, and the energy supply amount calculation unit 33 is replaced with an energy supply amount estimation unit 142 in the ignition control unit 24 according to the first embodiment illustrated in FIG. 3.

The irregular flow ratio estimation unit (irregular flow ratio estimation unit 141) estimates an estimated value of the irregular flow ratio (irregular flow ratio R) indicating that the flow of the air-fuel mixture in the cylinder of the internal combustion engine (internal combustion engine ENG) is irregular based on the operating state of the internal combustion engine (internal combustion engine ENG). Therefore, the irregular flow ratio estimation unit 141 estimates an estimated value Re of the irregular flow ratio based on the input ignition timing, valve timing, tumble control valve opening degree, accelerator opening degree, and rotation speed. The irregular flow ratio R estimated by the irregular flow ratio estimation unit 141 is input to the advance angle/energy correction determination unit 35.

The energy supply amount estimation unit (energy supply amount estimation unit 142) estimates an energy supply amount of the supply energy E supplied to the ignition coil (ignition coil 16) by the ignition energization time for energizing the primary side of the ignition coil (ignition coil 16). At this time, the energy supply amount estimation unit 142 estimates the supply energy E to the air-fuel mixture flowing into the cylinder of the internal combustion engine ENG. Then, the energy supply amount estimation unit 142 estimates the supply energy E based on a positive correlation between the input ignition energization time (Dwell) and the supply energy E. The supply energy E estimated by the energy supply amount estimation unit 142 is input to the advance angle/energy correction determination unit 35.

The correction determination unit (advance angle/energy correction determination unit 35) determines whether or not the ignition operation amount is corrected based on an estimated value (set ratio value) of the irregular flow ratio (irregular flow ratio R), the energy supply amount, and a target value of the irregular flow ratio (irregular flow ratio R). Here, the target value of the irregular flow ratio (irregular flow ratio R) includes the set ratio value (set ratio value Tr), and the correction determination unit (advance angle/energy correction determination unit 35) determines whether or not the correction for reducing the supply energy is performed when the estimated value of the irregular flow ratio (irregular flow ratio R) is equal to or less than the set ratio value (set ratio value Tr).

The ignition operation amount correction unit (ignition operation amount correction unit 37) corrects the ignition operation amount so that the estimated value of the irregular flow ratio (irregular flow ratio R) is less than or equal to the set ratio value (set ratio value Tr) that is the target to be reached of the irregular flow ratio (irregular flow ratio R). Here, the ignition operation amount correction unit (ignition operation amount correction unit 37) corrects the ignition correction amount when the correction determination unit (advance angle/energy correction determination unit 35) determines that the ignition operation amount is corrected. Other blocks are common to the first embodiment.

Figure 15:
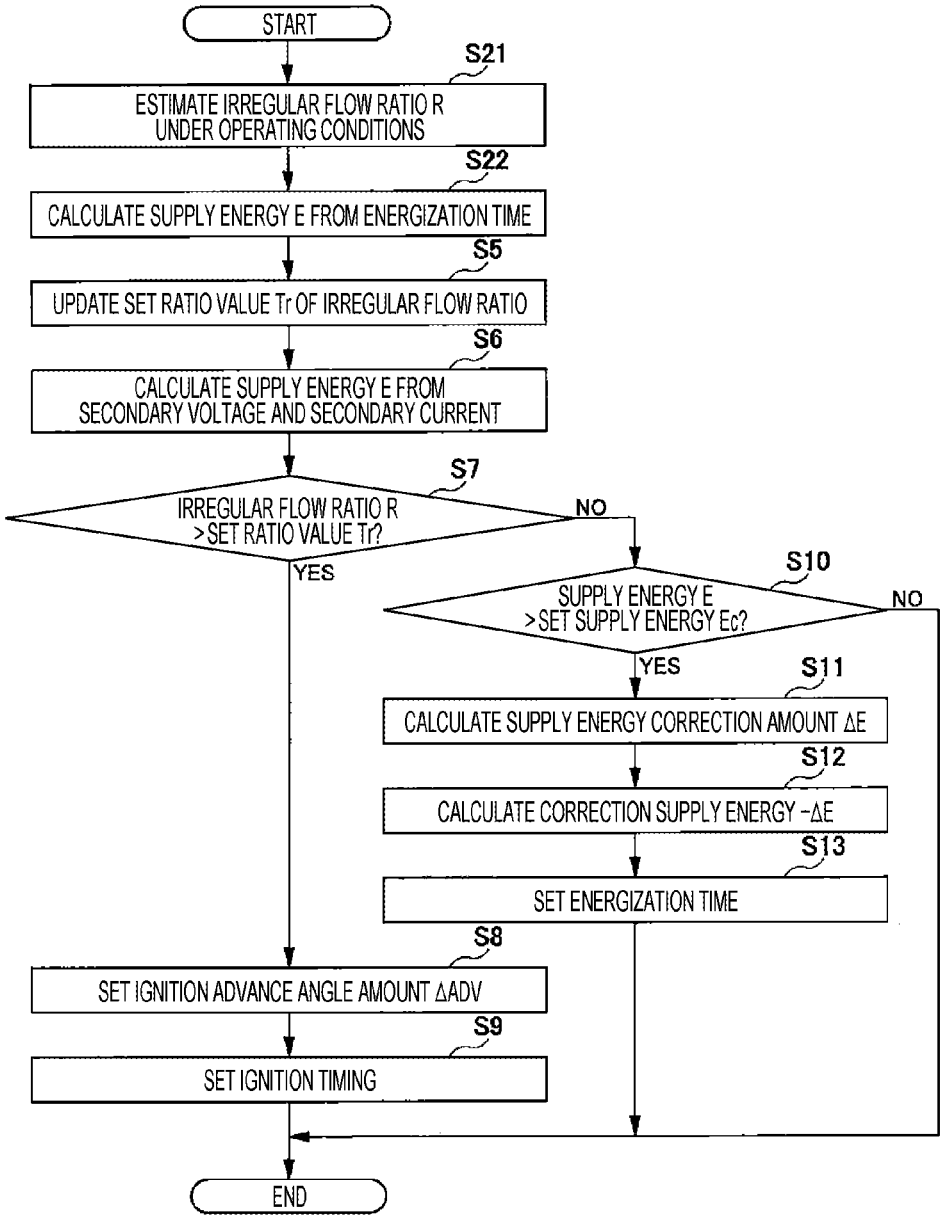
FIG. 15 is a flowchart illustrating an example of processing executed by each control block in the ignition control unit according to the second embodiment of the present invention.

FIG. 15 is a flowchart illustrating the processing executed by each control block illustrated in FIG. 14. An operation example and an effect of the ignition control unit 24A according to the second embodiment will be described with reference to FIG. 15.

First, the irregular flow ratio estimation unit 141 estimates the irregular flow ratio R under operating conditions in consideration of the input ignition timing, valve timing, tumble control valve opening degree, required torque, and rotation speed (S21). Here, the irregular flow ratio estimation unit 141 estimates the irregular flow ratio R using a set ratio value Tr of the irregular flow ratio, an irregular flow ratio increase amount ΔR due to the change in the ignition timing, an irregular flow ratio magnification RI due to the change in the intake valve closing timing, a flow ratio magnification Rt according to the tumble control valve opening degree. A method of determining each value will be described below.

The irregular flow ratio set ratio value Tr is obtained from the map illustrated in FIG. 6 by inputting the rotation speed and the required torque of the internal combustion engine ENG by the irregular flow ratio estimation unit 141.

Figure 16:
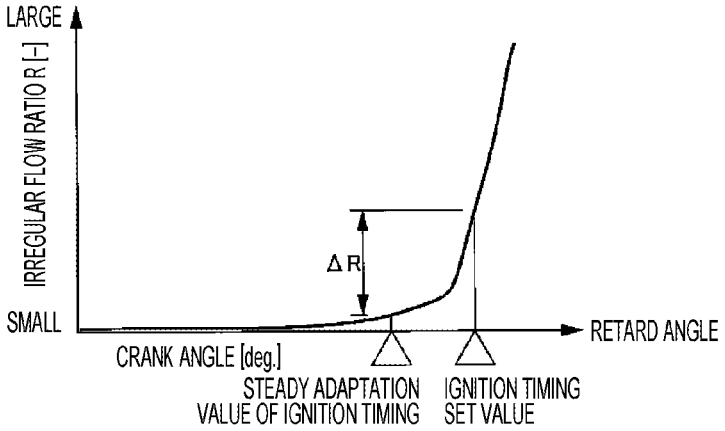
FIG. 16 is a chart diagram representing a relationship between a crank angle and an irregular flow ratio according to the second embodiment of the present invention.

The irregular flow ratio increase amount ΔR due to the change in the ignition timing is obtained by the irregular flow ratio estimation unit 141 based on a relationship between the crank angle and the irregular flow ratio as illustrated in FIG. 16.

FIG. 16 is a chart diagram representing a relationship between the crank angle and the irregular flow ratio R.

As illustrated in FIG. 16, when a steady adaptation value of the ignition timing and an actual ignition timing set value deviate from each other, the irregular flow ratio R changes.

Therefore, the relationship between the crank angle and the irregular flow ratio R is prepared, and is provided in the ECU 20. As a result, the irregular flow ratio estimation unit 141 can calculate a change amount ΔR of the irregular flow ratio caused by a difference between the set ignition timing and the steady adaptation value. Then, the irregular flow ratio estimation unit (irregular flow ratio estimation unit 141) estimates the irregular flow ratio (irregular flow ratio R) to be larger as the ignition timing of the ignition plug 17 is retarded. As a result, the irregular flow ratio estimation unit 141 can estimate the estimated value of the irregular flow ratio according to the ignition timing.

Note that the relationship between the crank angle and the irregular flow ratio R illustrated in FIG. 16 can be used to calculate the change amount ΔR of the irregular flow ratio by creating it in advance at a plurality of operating points by experiment and storing it in the ECU 20.

In addition, a map similar to the map representing the relationship between the rotation speed and the torque of the internal combustion engine illustrated in FIG. 6 is stored in the ECU 20. Then, the irregular flow ratio estimation unit (irregular flow ratio estimation unit 141) estimates the irregular flow ratio (irregular flow ratio R) to be smaller as the rotation speed of the internal combustion engine (internal combustion engine ENG) increases, and estimates the irregular flow ratio (irregular flow ratio R) to be larger as the torque of the internal combustion engine (internal combustion engine ENG) increases. As a result, the irregular flow ratio estimation unit 141 can estimate the estimated value of the irregular flow ratio according to the torque of the internal combustion engine ENG.

Since the flow evaluated at the same crank angle is attenuated as the intake valve closing time advances, the irregular flow ratio R tends to increase as the intake valve closing time advances. A relationship between the intake valve closing timing and the irregular flow ratio R is mapped as illustrated in FIG. 7. As described above, FIG. 7 illustrates the relationship between the irregular flow ratio magnification RI, which is the magnification from the irregular flow ratio R at the reference valve position, and the intake valve closing timing. Then, the irregular flow ratio estimation unit 141 corrects the estimated value Re of the irregular flow ratio using the ratio of the magnification RI1 at the steady adaptation value of the intake valve closing timing and the RI2 at the current set value illustrated in FIG. 7. Here, the irregular flow ratio estimation unit (irregular flow ratio estimation unit 141) estimates the irregular flow ratio (irregular flow ratio R) to be larger as the closing timing of the intake valve (intake valve 25) advances due to the operation of the variable valve (variable valve 5). As a result, the irregular flow ratio estimation unit 141 can estimate the estimated value of the irregular flow ratio according to the closing timing of the intake valve 25.

In addition, as the opening degree of the tumble control valve becomes smaller, the tumble flow evaluated at the same crank angle becomes faster. Therefore, the smaller the opening degree of the tumble control valve, the smaller the irregular flow ratio tends to be. As illustrated in FIG. 8 as described above, the relationship between the irregular flow ratio magnification Rt, which is the magnification from the irregular flow ratio R when the tumble control valve is fully closed, and the tumble control valve opening degree is mapped. Then, the irregular flow ratio estimation unit 141 corrects the estimated value Re of the irregular flow ratio using the ratio of the magnification Rt1 at the steady adaptation value of the tumble control valve opening degree and Rt2 at the current set value illustrated in FIG. 8. Here, the irregular flow ratio estimation unit (irregular flow ratio estimation unit 141) estimates the irregular flow ratio (irregular flow ratio R) to be smaller as the opening degree of the tumble control valve (tumble control valve 8) is smaller. As a result, the irregular flow ratio estimation unit 141 can estimate the estimated value of the irregular flow ratio according to the opening degree of the tumble control valve.

Summarizing the above correction methods, the irregular flow ratio estimation unit 141 can estimates the estimated value Re of the irregular flow ratio by the following Equation (12) using the set ratio value Tr of the irregular flow ratio R.

$$Re=(Tr+\Delta R)\times(RI2/RI1)\times(Rt2/Rt1) \quad (12)$$

The irregular flow ratio magnification Rt according to the tumble control valve opening degree is obtained based on the relationship between the tumble control valve opening degree diagram and the irregular flow ratio magnification as illustrated in FIG. 8. When the tumble control valve opening degree becomes smaller, the speed of the intake air into the cylinder increases, the tumble flow becomes stronger, and the irregular flow ratio evaluated at the same crank angle tends to decrease. The change in which the magnification is reduced under the condition that the tumble control valve opening degree is small as illustrated in FIG. 8 indicates such property.

By configuring the irregular flow ratio estimation method in this way, the ignition control unit 24A can estimate the irregular flow ratio R as the estimated value Re without measuring the current or voltage of the ignition coil 16. Then, ignition control according to the estimated value Re of the irregular flow ratio becomes possible.

Then, after the irregular flow ratio estimation unit 141 estimates the estimated value Re of the irregular flow ratio, the processing proceeds to step S22.

Next, the energy supply amount estimation unit 142 estimates the supply energy from the set ignition energization time (S22). Since the relationship between the ignition energization time and the supply energy is determined according to the characteristics of the ignition coil 16, the ECU 20 has the relationship between the ignition energization time and the supply energy as a map, and estimates the supply energy from such a relationship. The larger the ignition energization time, the larger the supply energy. Since the energy supply amount estimation unit 142 can estimate the supply energy in this way, the ignition control unit 24A can calculate the supply energy without measuring the current or voltage of the ignition coil 16.

Since the processing (steps S5 to S13) after step S22 is the same as the processing performed by the ignition control unit 24 according to the first embodiment described above, a detailed description thereof will be omitted. However, the processing in step S7 is different in that the estimated irregular flow ratio R and the set ratio value Tr are compared.

Figure 17:
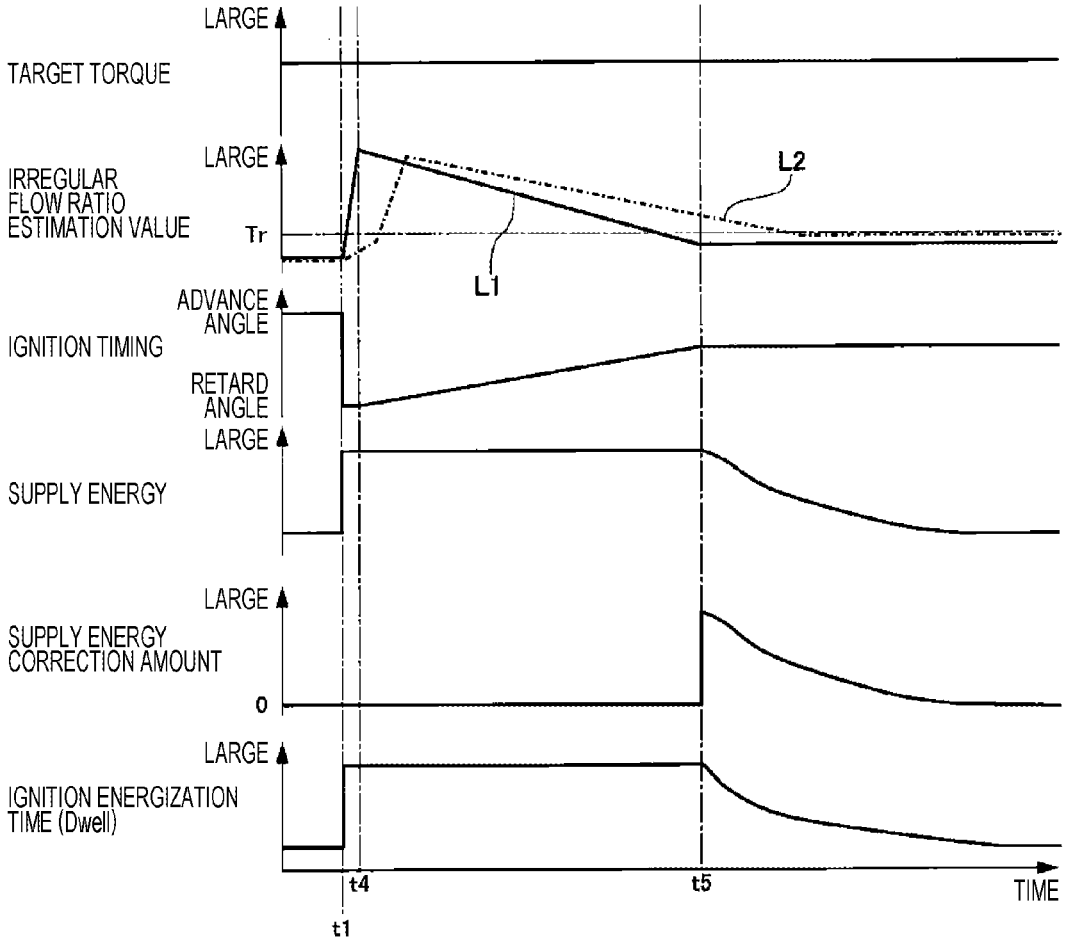
FIG. 17 is a timing chart representing a relationship between a value calculated by the ignition control unit and an ignition operation amount according to the second embodiment of the present invention.

FIG. 17 is a timing chart illustrating a relationship between the value calculated by the ignition control unit 24A and the ignition operation amount according to the second embodiment. An operation example and an effect of the ignition control unit 24A according to the second embodiment will be described with reference to FIG. 17.

(Time t1)

Since each value in an initial state is the same as the timing chart illustrated in FIG. 13, it will be described from time t1. As described above, from time t1, it is assumed that ignition retard control is performed due to a knock occurrence or other factors under the condition that the target torque is constant. As illustrated in FIG. 9, when the ignition timing is performed at a retarded angle, the required energy increases. Therefore, the supply energy also increases in accordance with the control that the ignition timing is performed at a retarded angle.

(Time t4)

In the present embodiment, the irregular flow ratio R is estimated as the irregular flow ratio Re with the ignition timing as an input. Therefore, when the ignition timing is controlled by a retard angle as illustrated by a solid line L1 in the figure, the irregular flow ratio estimation value Re exceeds the set ratio value Tr of the irregular flow ratio at time t4, which is the timing of a next cycle. Therefore, based on the result of the determination processing in step S7 of FIG. 15, the control with the ignition timing as the advance angle is started from the next cycle onward (S8, S9). As the ignition timing is controlled in the advance angle direction, the estimated value Re of the irregular flow ratio begins to decrease. Note that in the figure, the calculation value of the irregular flow ratio R calculated based on the average value of the secondary voltage is represented by an alternate long and short dash line L2 so as to be compared.

(Time t5)

At time t5, the estimated value Re of the irregular flow ratio is lower than the set ratio value Tr of the irregular flow ratio. Therefore, based on the result of the determination processing in step S7, the supply energy correction amount ΔE changes so as to reduce and correct the supply energy from the next cycle onward, and the ignition energization time gradually decreases. As described above, the supply energy can be controlled by using the estimated value Re of the irregular flow ratio by the processing performed by the ignition control unit 24A according to the second embodiment.

Also in the ECU 20 according to the second embodiment described above, it is possible to control to reduce the supply energy under the condition that the estimated value Re of the irregular flow ratio is equal to or less than the set ratio value Tr of the irregular flow ratio without measuring the primary voltage or the secondary current of the ignition coil 16.

In addition, the ignition control unit 24A according to the present embodiment obtains the estimated value Re of the irregular flow ratio. As illustrated in FIG. 17, the estimated value Re of the irregular flow ratio changes faster than the change of the calculation value of the irregular flow ratio R. Therefore, by controlling the supply energy based on the estimated value Re of the irregular flow ratio estimated by the ignition control unit 24A, since the ignition plug 17 is discharged by applying an appropriate voltage, the life of the ignition plug 17 can be extended.

Third Embodiment

Next, a control example performed by the ECU 20 according to a third embodiment of the present invention will be described. The configuration of the ECU 20 according to the third embodiment is the same as the configuration of the ECU 20 according to the first embodiment and the second embodiment described with reference to FIGS. 1 and 2. Therefore, a configuration example and an operation example of the ECU 20 according to the third embodiment will be described with reference to FIGS. 18 to 23.

Figure 18:
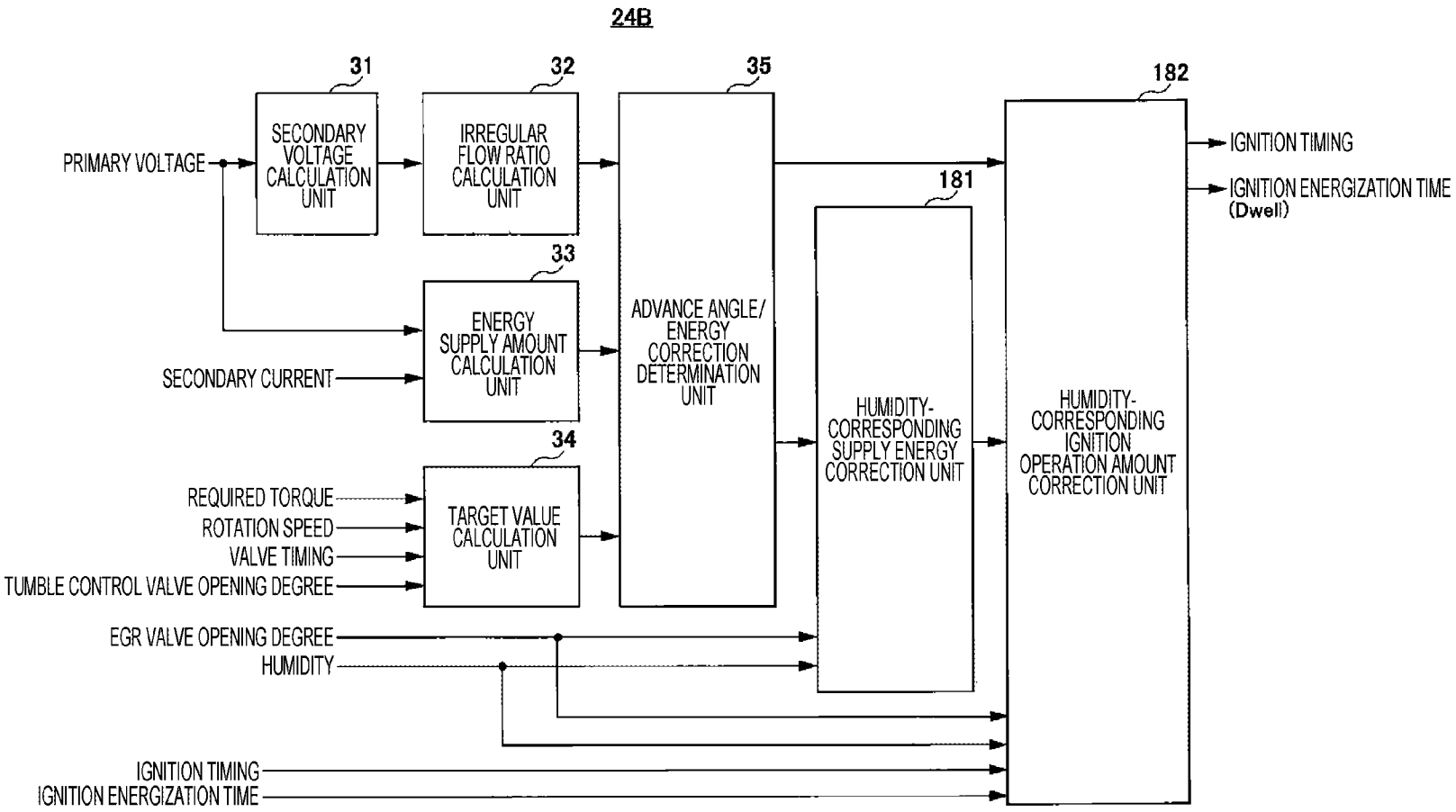
FIG. 18 is a block diagram illustrating an internal configuration example of an ignition control unit included in an ECU which is a control device of an internal combustion engine according to a third embodiment of the present invention.

FIG. 18 is a block diagram illustrating an internal configuration example of an ignition control unit 24B included in the ECU 20 which is a control device for the internal combustion engine ENG according to the third embodiment of the present invention. In the ignition control unit 24B as well, in order to control the supply energy of the ignition plug 17, the ignition operation amount including at least one of the ignition timing of the ignition plug 17 and the ignition energization time of the ignition coil 16 is corrected.

The ignition control unit 24B has a configuration in which the supply energy correction unit 36 is replaced with a humidity-corresponding supply energy correction unit 181, and the ignition operation amount correction unit 37 is replaced with a humidity-corresponding ignition operation amount correction unit 182 in the ignition control unit 24 according to the first embodiment illustrated in FIG.

The humidity-corresponding supply energy correction unit 181 calculates a reduction correction amount of the supply energy based on the determination result input from the advance angle/energy correction determination unit 35, the EGR valve opening degree input from the sensor that detects the opening degree of the EGR valve 101, and the humidity detection value of the humidity sensors 3*a* and 3*b*, and calculates a supply energy target value of the corresponding cycle. The supply energy target value is input to the humidity-corresponding ignition operation amount correction unit 182.

The humidity-corresponding ignition operation amount correction unit 182 calculates an ignition advance angle amount based on the determination result input from the advance angle/energy correction determination unit 35, the supply energy target value input from the humidity-corresponding supply energy correction unit 181, the input EGR valve opening degree, and the humidity calculation value, and corrects the ignition timing. In addition, the humidity-corresponding ignition operation amount correction unit 182 sets a correction value of the ignition energization time (Dwell). Then, the humidity-corresponding ignition operation amount correction unit 182 outputs the calculated correction value of the ignition timing and the correction value of the ignition energization time to the ignition coil 16.

The processing executed in each block of FIG. 18 is basically the same as the flowchart illustrated in FIG. 4. However, the difference is that the processing of step S11 performed by the supply energy correction unit 36 is performed by the humidity-corresponding supply energy correction unit 181, and the processing of step S8 performed by the ignition operation amount correction unit 37 is performed by the humidity-corresponding ignition operation amount correction unit 182. Hereinafter, the contents of the processing in steps S11 and S8 will be described with reference to FIGS. 19 to 22.

First, in step S11 of FIG. 4, the content of the processing performed by the humidity-corresponding supply energy correction unit 181 will be described with reference to FIGS. 19 and 20.

Figure 19:
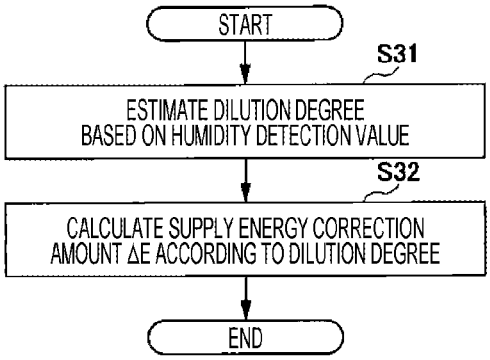
FIG. 19 is a flowchart illustrating an example of processing performed by a humidity-corresponding supply energy correction unit according to the third embodiment of the present invention.

FIG. 19 is a flowchart illustrating an example of processing performed by the humidity-corresponding supply energy correction unit 181.

First, the humidity-corresponding supply energy correction unit 181 estimates the dilution degree of the intake gas introduced into the cylinder based on the input humidity detection value and the EGR valve opening degree (S31). For example, it is assumed that a fuel composition of the gas is CnHm (n carbon atoms, and m hydrogen atoms). In addition, it is assumed that the humidity sensor 3*a* detects atmospheric humidity z (moisture density/dry air density), the humidity sensor 3*b* detects a ratio X of the moisture density and the total gas density in the intake gas, and combustion is carried out in the internal combustion engine ENG at a stoichiometric mixture ratio. In this case, if the dilution degree is defined by a ratio of the mass of the gas other than air to the mass of the total gas including the air, the dilution degree Yd is given by the following Equation (13).

$$Yd=\{(1+y)Mw+yMb\}/\{Ma(1+y)Mw+yMb\} \quad (13)$$

However, y, Ma, Mw, and Mb are the quantities given as illustrated below. Here, Wair is a molar mass of air, Wco2 is a molar mass of carbon dioxide, Wh2*o* is a molar mass of water, and Wn2 is a molar mass of nitrogen molecules.

$$y=\{(1-X)Mw-XMa\}/\{X(Mw+Mb)-Mw-mWh2o\}$$

$$Ma=5(n+0.5m)W\text{air}$$

$$Mw=5(n+0.5m)zW\text{air}$$

$$Mb=nWco2+m\text{H2O}+(4n+2m)Wn2$$

In this way, the humidity-corresponding supply energy correction unit 181 estimates the dilution degree of the intake gas (the ratio of the mass of the gas other than air and the mass of the total gas) based on the humidity detection value (ratio of the moisture density in the intake gas to the total gas density). Therefore, the dilution degree calculated from the humidity can be applied to the control. Note that the above Equation (13) is an example, and if the assumed situation is not satisfied, the humidity-corresponding supply energy correction unit 181 may estimate the dilution degree by a different method.

Next, the humidity-corresponding supply energy correction unit 181 calculates the supply energy correction amount ΔE based on the dilution degree or the humidity (S32). Here, the humidity-corresponding supply energy correction unit 181 determines the supply energy correction amount ΔE based on the supply energy E, the set supply energy Ec, and the supply energy correction amount magnification rE. In order to gradually bring the supply energy E to approach the set supply energy Ec, which is the target value, the supply energy correction amount ΔE can be obtained by, for example, the following Equation (14).

$$\Delta E=(E-Ec)/\text{Niter}\times rE \quad (14)$$

Here, the supply energy correction amount magnification rE will be described.

Figure 20:
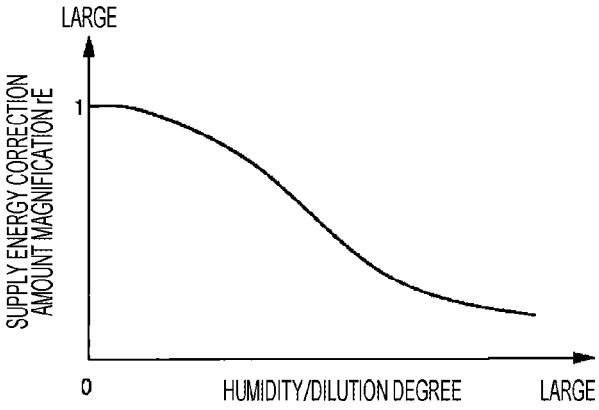
FIG. 20 is a chart illustrating a relationship between a supply energy correction amount magnification and a humidity or a dilution degree according to the third embodiment of the present invention.

FIG. 20 is a chart illustrating a relationship of the supply energy correction amount magnification rE with respect to the humidity or the dilution degree.

The supply energy correction amount magnification rE is given as a function of dilution degree and humidity as illustrated in FIG. 20. The higher the dilution degree and humidity of the intake gas, the more rapidly the combustion stability may change due to the decrease in the supply energy supplied to the air-fuel mixture. Therefore, the ignition operation amount correction unit (humidity-corresponding ignition operation amount correction unit 182) sets the supply energy correction amount calculated by the supply energy correction unit (humidity-corresponding supply energy correction unit 181) to be smaller as the humidity of the gas (intake gas) detected by the humidity detection unit (humidity sensors 3*a* and 3*b*) increases. Therefore, the supply energy correction amount magnification rE is set so that the supply energy correction amount LE becomes smaller as the dilution degree or the humidity is higher.

Note that Niter used in Equation (14) is a variable that defines how many cycles the speed at which the supply energy E gradually approaches the set supply energy Ec, which is the target value, is applied, and is a real number larger than 1. After the humidity-corresponding supply energy correction unit 181 determines the supply energy correction amount ΔE, the processing proceeds to step S12. By setting the supply energy correction amount LE in this way, it is possible to correct the decrease in the supply energy E in consideration of the increase in humidity. In addition, by setting the supply energy correction amount ΔE, even under high humidity conditions where combustion tends to become unstable (conditions where the humidity of intake air is high), it is possible to prevent a state in which combustion becomes unstable due to an excessive energy reduction amount.

Next, in step S8 of FIG. 4, the content of the processing performed by the humidity-corresponding ignition operation amount correction unit 182 will be described with reference to FIGS. 21 and 22.

Figure 21:
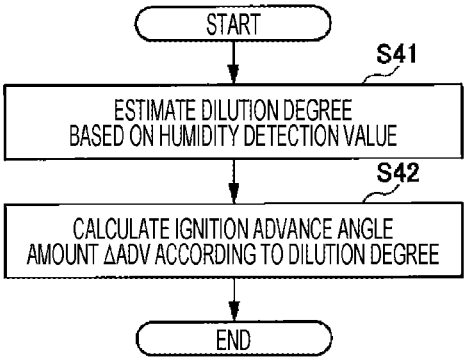
FIG. 21 is a flowchart illustrating an example of processing performed by the humidity-corresponding ignition operation correction unit according to the third embodiment of the present invention.

FIG. 21 is a flowchart illustrating an example of processing performed by the humidity-corresponding ignition operation amount correction unit 182.

First, the humidity-corresponding ignition operation amount correction unit 182 estimates the dilution degree based on the input humidity detection value (S41). At this time, the humidity-corresponding ignition operation amount correction unit 182 can estimate the dilution degree by performing the processing in step S31 of FIG. 19 and using Equation (13).

Next, the humidity-corresponding ignition operation amount correction unit 182 calculates an ignition advance angle amount ΔADV according to the dilution degree and the humidity (S42). At this time, the humidity-corresponding ignition operation amount correction unit 182 obtains the ignition advance angle amount ΔADV by the following Equation (15) using an adaptation value ΔADVref of the advance angle amount [deg.] or an advance angle velocity [deg./ms] given as a fixed value under the adaptation operating conditions and an ignition advance angle correction magnification rA. As described above, in the third embodiment, the ignition advance angle amount ΔADV is a value determined according to the dilution degree and the humidity.

$$\Delta\text{ADV}=rA\times\Delta\text{ADVref} \quad (15)$$

Here, an ignition advance angle correction magnification rA will be described.

Figure 22:
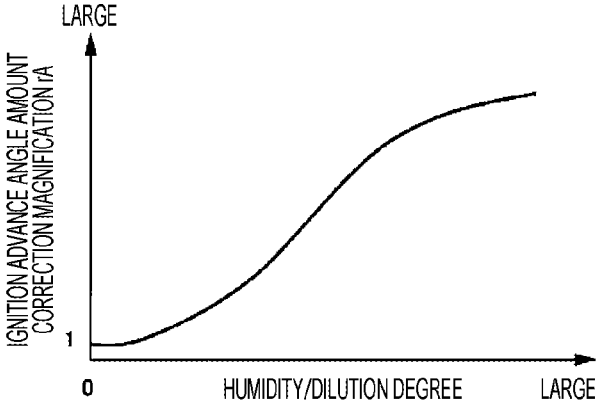
FIG. 22 is a chart illustrating a relationship between an ignition advance angle amount correction magnification and the humidity or the dilution degree according to the third embodiment of the present invention.

FIG. 22 is a chart illustrating a relationship of the ignition advance angle correction magnification rA with respect to the humidity or the dilution degree.

The ignition advance angle correction magnification rA is given as a function of dilution degree and humidity as illustrated in FIG. 22. The higher the humidity and the dilution degree, the more likely it is that the ignition timing will become unstable when the ignition timing is retarded. Therefore, it is effective to advance the ignition timing earlier than usual and bring it to stable conditions. Therefore, the ignition operation amount correction unit (humidity-corresponding ignition operation amount correction unit 182) increases the advance correction amount that corrects the ignition timing of the ignition plug (ignition plug 17) to the advance angle as the humidity of the gas detected by the humidity detection unit (humidity sensors 3*a* and 3*b*) increases. Therefore, the ignition advance angle correction magnification rA is set so that the higher the humidity and the dilution degree, the larger the value. When the humidity-corresponding ignition operation amount correction unit 182 calculates the ignition advance angle amount ΔADV, the processing proceeds to step S9, and a subsequent processing is performed.

Since the ignition advance angle amount ΔADV is calculated in this way, a period for setting an ignition retard angle can be shortened even under high humidity conditions where combustion tends to be unstable, and it becomes possible to operate the internal combustion engine ENG more stably.

Figure 23:
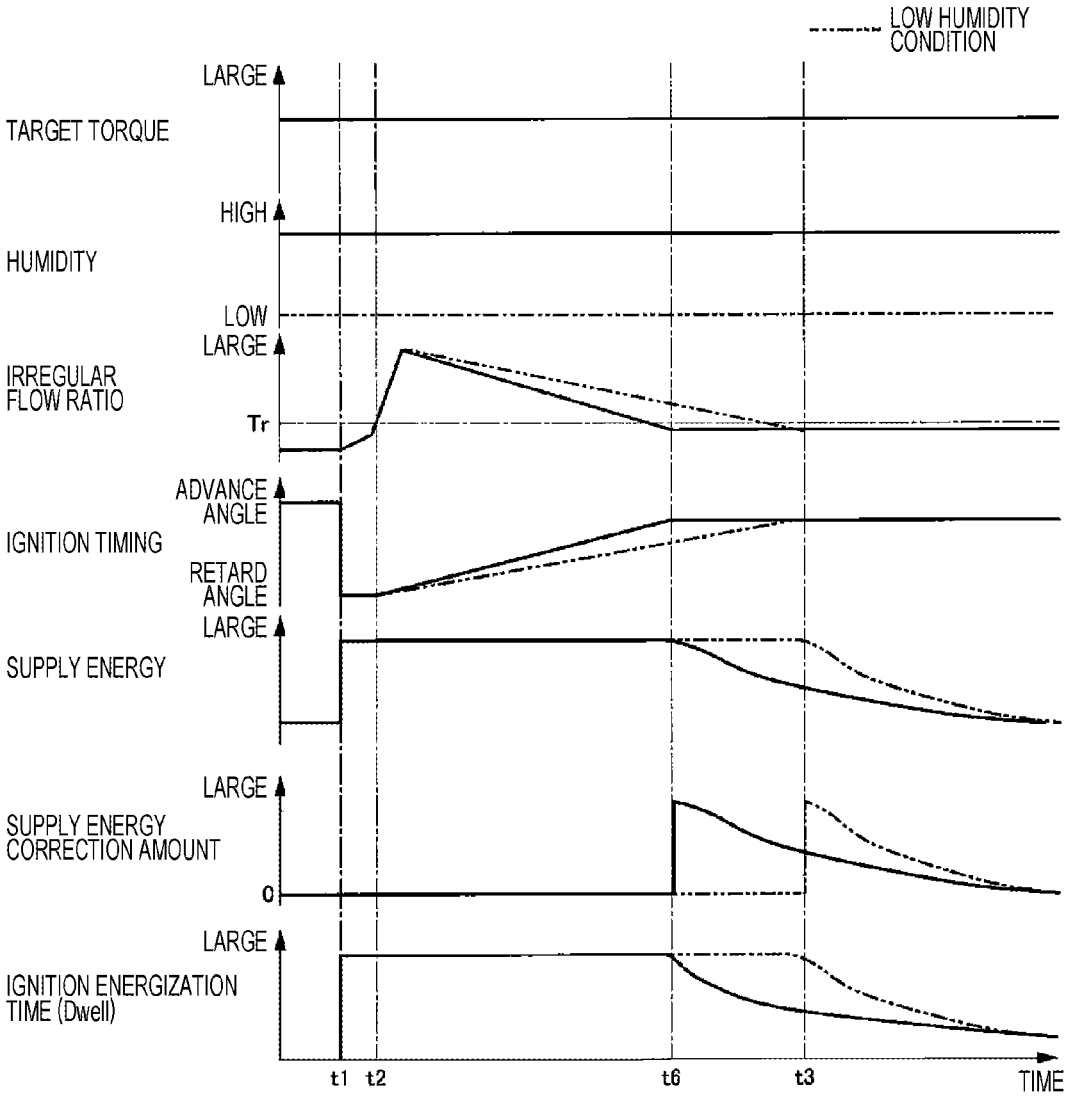
FIG. 23 is a timing chart representing a relationship between a value calculated by the ignition control unit and an ignition operation amount according to the third embodiment of the present invention.

FIG. 23 is a timing chart illustrating a relationship between the value calculated by the ignition control unit 24B and the ignition operation amount according to the third embodiment. An operation example and an effect of the ignition control unit 24B according to the third embodiment under high humidity conditions will be described with reference to FIG. 23.

Note that an item indicating that the humidity condition is high is added to the timing chart illustrated in FIG. 23. Then, in FIG. 23, the chart corresponding to FIG. 13 under the low humidity condition is represented by a two-dot chain line for comparison, and the chart according to the present embodiment under the high humidity condition is represented by a solid line.

(Time t1)

Since each value in an initial state is the same as the timing chart illustrated in FIG. 13, it will be described from time t1. Also in FIG. 23, from time t1, it is assumed that ignition retard control is performed due to a knock occurrence or other factors under the condition that the target torque is constant. When the ignition timing is performed at a retard angle, the calculated irregular flow ratio begins to increase. As illustrated in FIG. 9, since the ignition timing is controlled in the retard angle direction and the required energy increases, the supply energy also increases.

(Time t2)

At time t2, the irregular flow ratio R exceeds the set ratio value Tr of the irregular flow ratio as the supply energy E increases. At this timing, control with the ignition timing as the advance angle starts through the determination processing in step S7 of FIG. 4 (S8, S9). As the ignition timing is controlled in the advance angle direction, the irregular flow ratio R decreases.

(Time t6)

Under high humidity conditions, the advance angle amount of the ignition timing is set larger than that under low humidity conditions. As a result, the ignition timing advances faster than in the low humidity condition. Therefore, the calculated irregular flow ratio R begins to decrease, and the irregular flow ratio R falls below the set ratio value Tr of the regular flow ratio at time t6. In addition, since the supply energy correction amount LE increases so as to reduce and correct the supply energy, the ignition energization time gradually decreases. Here, the supply energy correction amount is set smaller than the low humidity condition in consideration of the humidity of the intake air. Therefore, the ignition energization time is gradually reduced as compared with the low humidity condition.

(Time t3)

Time t3 illustrates how each value changes under low humidity conditions as illustrated in FIG. 13. FIG. 23 illustrates that the timing at which each value changes under high humidity conditions is earlier than the timing at which each value changes under low humidity conditions.

In the ignition control unit 24B included in the ECU 20 according to the third embodiment described above, the ignition advance angle amount and the supply energy can be operated in consideration of the change in the relationship between the ignition timing and the stable combustion state due to the increase in humidity. As a result, even under the high humidity conditions, the supply energy can be reduced without destabilizing the combustion state, so that heat generation of the ignition coil 16 and wear of the ignition plug 17 can be suppressed.

It should be noted that the present invention is not limited to the above-described embodiments, and it goes without saying that various other application examples and modifications can be taken as long as the gist of the present invention described in the claims is not deviated.

For example, the above-described embodiment describes the configuration of the internal combustion engine system in detail and concretely in order to explain the present invention in an easy-to-understand manner, and is not necessarily limited to the one including all the configurations described. In addition, it is possible to add, delete, and replace other components with respect to some of the components of the respective embodiments.

In addition, control lines and information lines indicate what is considered necessary for explanation, and not necessarily all the control lines and information lines on the product. In practice, it can be considered that almost all configurations are connected to each other.

REFERENCE SIGNS LIST

1 air flow sensor
2 electronically controlled throttle
5 variable valve
8 tumble control valve
13 injector
14 cylinder
16 ignition coil
17 ignition plug
20 ECU
24 ignition control unit
25 intake valve
31 secondary voltage calculation unit
32 irregular flow ratio calculation unit
33 energy supply amount calculation unit
34 target value calculation unit
35 advance angle/energy correction determination unit
36 supply energy correction unit
37 ignition operation amount correction unit

The invention claimed is:

1. A control device that includes an ignition control unit that supplies a primary voltage to a primary side of an ignition coil provided in an internal combustion engine according to a predetermined ignition operation amount, discharges an ignition plug provided in the internal combustion engine, and controls an ignition of an air-fuel mixture in which a gas sucked into a cylinder of the internal combustion engine and a fuel are mixed, and that controls the internal combustion engine by the ignition control unit, wherein the ignition control unit includes:

a secondary voltage calculation unit that calculates an average value of a secondary voltage generated on a secondary side of the ignition coil;

an irregular flow ratio calculation unit that calculates a ratio of a cycle in which the average value of the secondary voltage is equal to or less than a set average value with respect to a cycle of the internal combustion engine in a predetermined period as an irregular flow ratio indicating that a flow of the air-fuel mixture in the cylinder is irregular; and an ignition operation amount correction unit that corrects the ignition operation amount so that the irregular flow ratio is equal to or less than a set ratio value that is a target to be reached of the irregular flow ratio.

2. The control device according to claim 1, wherein the ignition control unit includes:

an energy supply amount calculation unit that calculates an energy supply amount of a supply energy supplied by the ignition plug to the air-fuel mixture based on the average value of the secondary voltage calculated by the secondary voltage calculation unit and a secondary current of the ignition coil detected by a current sensor attached to the ignition coil;

a target value calculation unit that calculates a target value of the irregular flow ratio based on an operating state of the internal combustion engine; and a correction determination unit that determines whether or not to correct the ignition operation amount based on the irregular flow ratio, the energy supply amount, and the target value of the irregular flow ratio, and the ignition operation amount correction unit corrects the ignition operation amount when the correction determination unit determines that the correction of the ignition operation amount is performed.

3. The control device according to claim 2, wherein the target value of the irregular flow ratio includes the set ratio value, and the correction determination unit determines whether or not a correction for reducing the supply energy generated on the secondary side of the ignition coil is performed when the irregular flow ratio is equal to or less than the set ratio value.

4. The control device according to claim 3, further comprising a supply energy correction unit that calculates a supply energy correction amount for performing the correction for reducing the supply energy and outputs the supply energy correction amount to the ignition operation amount correction unit, when the correction determination unit determines that the correction for reducing the supply energy is performed, wherein the ignition operation amount correction unit reduces the supply energy based on the supply energy correction amount input from the supply energy correction unit.

5. The control device according to claim 4, wherein the target value of the irregular flow ratio includes a set supply energy representing the supply energy supplied by the ignition plug to the air-fuel mixture at the set ratio value, the supply energy correction unit calculates a difference between the set supply energy and the supply energy as a supply energy correction amount, when the irregular flow ratio is equal to or less than the set ratio value, and the ignition operation amount correction unit reduces the supply energy based on the supply energy correction amount input from the supply energy correction unit.

6. The control device according to claim 5, wherein the ignition operation amount correction unit corrects an ignition energization time for energizing the primary side of the ignition coil.

7. The control device according to claim 1, wherein the ignition operation amount correction unit corrects an ignition timing of the ignition plug to an advance angle when the irregular flow ratio exceeds the set ratio value.

8. The control device according to claim 2, wherein the target value calculation unit sets the set ratio value to be smaller as the rotation speed of the internal combustion engine is higher and the torque of the internal combustion engine is smaller, and sets the set ratio value to be larger as the rotation speed of the internal combustion engine is lower and the torque of the internal combustion engine is larger.

9. The control device according to claim 2, wherein the internal combustion engine includes a tumble control valve that changes a flow velocity of gas flowing into the cylinder, and the target value calculation unit sets the set ratio value to be smaller as an opening degree of the tumble control valve is smaller.

10. The control device according to claim 2, wherein the internal combustion engine includes a variable valve that changes a timing at which an intake valve provided in the internal combustion engine operates, and the target value calculation unit sets the set ratio value to be larger as a closing timing of the intake valve advances due to the operation of the variable valve.

11. The control device according to claim 6, wherein a required energy determined from a combustion stability of the air-fuel mixture increases as the ignition timing becomes retarded compared to the set supply energy at an optimum ignition timing when the ignition timing of the ignition plug is at the advance angle.

12. The control device according to claim 6, wherein the internal combustion engine includes a humidity detection unit that detects a humidity of the gas introduced into the cylinder, and the ignition operation amount correction unit sets the supply energy correction amount calculated by the supply energy correction unit to be smaller as the humidity of the gas detected by the humidity detection unit is higher.

13. The control device according to claim 7, wherein the internal combustion engine includes a humidity detection unit that detects a humidity of the gas introduced into the cylinder, and the ignition operation amount correction unit increases an advance angle correction amount for correcting the ignition timing of the ignition plug to the advance angle as the humidity of the gas detected by the humidity detection unit is higher.

14. A control device that includes an ignition control unit that supplies a primary voltage to a primary side of an ignition coil provided in an internal combustion engine according to a predetermined ignition operation amount, discharges an ignition plug provided in the internal combustion engine, and controls an ignition of an air-fuel mixture in which a gas sucked into a cylinder of the internal combustion engine and a fuel are mixed, and that controls the internal combustion engine by the ignition control unit, wherein the ignition control unit includes:

an irregular flow ratio estimation unit that estimates an estimated value of an irregular flow ratio indicating that a flow of an air-fuel mixture in the cylinder is irregular based on an operating state of the internal combustion engine; and an ignition operation amount correction unit that corrects an ignition operation amount so that the estimated value of the irregular flow ratio is equal to or less than a set ratio value that is the target to be reached of the irregular flow ratio.

15. The control device according to claim 14, wherein the ignition control unit includes:

an energy supply amount estimation unit that estimates an energy supply amount of a supply energy supplied to the ignition coil according to an ignition energization time for energizing the primary side of the ignition coil, a target value calculation unit that calculates a target value of the irregular flow ratio based on the operating state of the internal combustion engine, and a correction determination unit that determines whether or not to correct the ignition operation amount based on the estimated value of the irregular flow ratio, the energy supply amount, and the target value of the irregular flow ratio, and the ignition operation amount correction unit corrects the ignition operation amount when the correction determination unit determines that the correction of the ignition operation amount is performed.

16. The control device according to claim 15, wherein the target value of the irregular flow ratio includes the set ratio value, and the correction determination unit determines whether or not a correction for reducing the supply energy is performed when the estimated value of the irregular flow ratio is equal to or less than the set ratio value.

17. The control device according to claim 15, wherein the irregular flow ratio estimation unit estimates the irregular flow ratio to be larger as the ignition timing of the ignition plug is retarded.

18. The control device according to claim 15, wherein the irregular flow ratio estimation unit estimates the irregular flow ratio to be smaller as a rotation speed of the internal combustion engine increases, and estimates the irregular flow ratio to be larger as torque of the internal combustion engine increases.

19. The control device according to claim 15, wherein the internal combustion engine includes a tumble control valve that changes a flow velocity of gas flowing into the cylinder, and the irregular flow ratio estimation unit estimates the irregular flow ratio to be smaller as an opening degree of the tumble control valve is smaller.

20. The control device according to claim 15, wherein the internal combustion engine includes a variable valve that changes a timing at which an intake valve provided in the internal combustion engine operates, and the irregular flow ratio estimation unit estimates the irregular flow ratio to be larger as a closing timing of the intake valve advances due to the operation of the variable valve.

* * * * *